US006893808B2

(12) United States Patent
Kobayashi et al.

(10) Patent No.: US 6,893,808 B2
(45) Date of Patent: May 17, 2005

(54) SILVER HALIDE PHOTOGRAPHIC MATERIAL

(75) Inventors: Hideyuki Kobayashi, Hino (JP); Kuniaki Uezawa, Hino (JP)

(73) Assignee: Konica Corporation (JP)

( * ) Notice: Subject to any disclaimer, the term of this patent is extended or adjusted under 35 U.S.C. 154(b) by 299 days.

(21) Appl. No.: 10/316,503

(22) Filed: Dec. 11, 2002

(65) Prior Publication Data

US 2003/0194662 A1 Oct. 16, 2003

(30) Foreign Application Priority Data

Dec. 20, 2001 (JP) ..... 2001-387495

(51) Int. Cl.[7] ..... G03C 3/02

(52) U.S. Cl. ..... 430/501; 430/944; 430/502; 430/503

(58) Field of Search ..... 430/501, 502, 430/503, 944

(56) References Cited

U.S. PATENT DOCUMENTS 6,641,987 B2 * 11/2003 Suga et al. ..... 430/505

* cited by examiner

*Primary Examiner*—Geraldine Letscher
(74) *Attorney, Agent, or Firm*—Muserlian, Lucas and Mercanti

(57) ABSTRACT

A silver halide photographic material which is in the form of a roll film packaged in a cartridge, and which exhibits superior print stability and is capable of providing prints with superior image quality when printed onto printing paper is disclosed, comprising on a support a red-sensitive layer, a green-sensitive layer and a blue-sensitive layer, wherein the quality value (QC) satisfies the following requirement $$QC \geqq 15.982 \times S^{-0.378} \quad (100 \leqq S \leqq 1600)$$

where S is the nominal speed of the photographic speed.

8 Claims, No Drawings

SILVER HALIDE PHOTOGRAPHIC MATERIAL

FIELD OF THE INVENTION

The present invention relates to a silver halide photographic material and in particular to a silver halide photographic material exhibiting superior print stability and capable of providing prints with superior image quality when printed onto printing paper.

BACKGROUND OF THE INVENTION

Based on recent progress in techniques for silver halide photographic materials used as general negative film for camera use (hereinafter, also denoted simply as photographic materials or negative film), photographic materials having a higher speed than the common speed of ISO 100 have become commercially available, one after another. Furthermore, the use of zoom lenses of a long focal length has increased along with popularization of compact cameras for amateur photographers. Thus, the full open value (lightness) of a lens has become smaller and the percentage of under-exposed scenes has increased compared to the past, resulting in lowering print productivity and finished print quality in photofinishing laboratories, and consequently, an immediate solution thereof is therefore desired.

When printing from an under-exposed negative film, high-light and shadow portions of the main subject in the under-exposed scene show poor density representation (tone reproduction), so that when the density of the subject is increased, the overall density increases, resulting in an excessively dark print; on the contrary, when the overall density is decreased, the density of the subject becomes lighter, resulting in blurred images and leading to print images not acceptable to customers. In such situations, the acceptable range of proper print density becomes narrower, resulting in printing difficulty.

Such appearance of under-exposed scenes often occur not only in the case of indoor photography, night photography, scenes having a relatively high dark proportion and photographing by using darker lenses such as a zoom lens, but also in the case of so-called photographing against light, such as a dark subject against the light background of the sky. It was proved from a survey that in such photography against light, few photographers realized that dark scenes were really photographed, often resulting in cases that the photographers discovered under-exposed photography when they obtained their prints from under-exposures. It was further proved that the difference between realization or expectation of the photographer and the real finished print quality was wide, often producing dominant causes of complaints for poor quality.

The speed in the foregoing photography system is generally called effective speed. It is commonly known that the effective speed in the negative-positive system using color negative film and color paper is more or less related with but is not simply connected to the commonly used color negative film speed as defined in ISO standards (hereinafter, also denoted simply as ISO speed).

Means for solving print quality problems of under-exposed scenes include, for example, enhancement of the ISP speed of color negative film. The silver halide emulsion speed is mainly dependent on silver halide crystal size and a technique of using a large grain silver halide emulsion to achieve enhanced speed, which is readily feasible and commonly practiced, as is known in the prior art or reported in literatures.

In fact, enhanced ISO speed can be achieved by the use of such a large silver halide grain emulsion, thereby also enhancing the effective speed in printing to some extent; however, the effect of solving the foregoing problems is low and on the contrary, the use of large silver halide grains produces rough graininess of the subsequent printed image. Specifically in cases when printed at a large magnification such as a 2L size or panorama size, printed images become coarse, producing complaints of prints being unacceptable by the photographers.

A single channel printer built-in with a scanner (hereinafter, also denoted as "1 ch. printer") can faithfully scan negative images using a CCD camera (i.e., image scanning) and can also conduct appropriate exposure control taking account of pattern analysis of the respective scenes. However, the fact remains that the print yield cannot be enhanced enough even by use of such printers and finished print quality by no means reaches satisfactory levels.

As described above, the print yield can be enhanced to some extent by recent progress in printer technique but further improvements are desired.

As a result of analysis by the inventors of this application using various types of printers and photographic materials to explore causes for the foregoing problems, it was proved that variation in color reproduction, specifically in under-exposures greatly affect variation in finished print quality (which is also called print level variation) and secondly, variation in color reproduction at a normal exposure level was also explored. It was further proved from a survey of print quality on the market that users complained that image quality of under-exposures did not meet the given quality standard for the respective film speeds.

To improve the print level variation of under-exposures, an attempt of stabilizing the density balance along with exposure variation over the range of the under-exposed region to the over-exposed region have been made through enhancement of photographic material speed by applying techniques proposed or disclosed in photographic literature and patents, but marked effects have not been achieved by anyone thereof. The correct printing exposure condition set in the printer is set by attaching importance to an average value on the market for each of various film speeds. Consequently, in response to variation of color temperature in the respective scenes (for example, according to a photographing environment such as fine weather, cloudy weather, shade and electric flash light), exposure conditions for a specified film speed, e.g., ISO 800 often results in a calculated value corresponding to a film speed of ISO 200 to 400, so that delicate exposure control is not achieved.

Appearance of under-exposed scenes accounts for approximately 20% in the current negative-positive system. However, total image quality of the thus under-exposed scenes is markedly inferior to normal- or over-exposure scenes accounting for 80% and therefore, enhancement in image quality of the under-exposed scenes is desired together with enhancement in total print image quality and print yield. As described in literature, for example, "Shashin-Kogaku no Kiso Ginene-Shashin" (Fundamentals of Photographic Engineering of Silver Salt Photography), published by Corona Publishing Co., it is known that sharpness and graininess greatly affect total image quality. For example, JP-A No. 10-268467 (hereinafter, the term, JP-A refers to Japanese Patent Application Publication) discloses a method of enhancing image quality by RMS granularity at a normal exposure or in vicinity thereof. However, total image quality in under-exposed scene, which differs from that of normal-exposure scenes cannot be accounted for only in terms of sharpness and graininess. Using a large amount of silver coverage or a dye forming coupler for enhancement of image quality results in an increase in cost, therefore, it cannot be said to be an efficient method.

Recently, besides the above-described printers of a conventional exposure control system, digital type or hybrid type printers are on the rise, in which image density information is obtained as digital information by scanning developed negative images and after being subjected to image processing, printing is performed based on that information.

In cases when using such printers, in addition to the foregoing problems in exposure control at under-exposure, problems arose with compression or deficiency of information when digitizing (or quantizing) information. This is due to the fact that negative film usually has information of a density of up to 3.5 (or gradation number of more than 300 levels) and contrary to that, an image in the standard format has to be compressed to a 256 level gradation at the time of quantization and a part of the information is often not properly transformed.

However, one disadvantage thereof is that when an under-exposed, low contrast scene is converted to proper contrast, incompatibility of the density range of the negative film (hereinafter, also denoted as negative density range) and the range of quantization excessively enhances contrast to a level higher than necessary for most people, resulting in deteriorated graininess or producing problems in that an excessive decrease of contrast is caused in high contrast scenes having a main subject differing in luminance from the background. Consequently, it was proved that the dynamic range was not fully employed, often producing an unnatural image print and tending to cause print level variation. In this regard, an improvement was made using a complicated algorithm with respect to some of phenomena, but it lowered productivity per hour and proved to be unacceptable in practice.

It was further proved that rapid access and diversification of photographic processing, according to recent market trend in the photographic industry, caused lowering in the SN ratio at the stage of digitization in silver halide photographic materials using silver above a given amount. This is assumed to be due to insufficient desilvering, in which metallic silver is retained in the coat due to an exhausted bleaching solution, resulting in lowering in SN ratio at the stage of negative-positive conversion of negative images in the process of digital printing. In cases when metallic silver was retained in processed negative film, location for the respective pictures was not accurately set up at the stage of scanning the negative film in a printer. Specifically in a scene taken with a low-priced camera which was poor in film-transport accuracy, even data of portions not relevant to the real scene (minimum density portions) were read in image processing, so that the dynamic range of positive image data (8 to 16 bits) was not effectively employed to perform positive image processing, resulting in a print exhibiting contrast, which was incongruity with a print obtained by a conventional analog type printer.

SUMMARY OF THE INVENTION

In view of the foregoing problems, the present invention was achieved. Thus, it is an object of the invention to provide a silver halide photographic material, which exhibits improved color stability and superior image quality when used in printing under-exposed scenes on printing paper by using an analog type printer and which also exhibits superior graininess, improved color stability and scanner suitability, and superior tone reproducibility when printed by using a digital type printer.

Specifically, the present invention was accomplished by the following constitution.

1. A silver halide photographic light sensitive material which is in the form of a roll film packaged in a cartridge, comprising on a support a red-sensitive layer, a green-sensitive layer and a blue-sensitive layer, wherein the photographic material satisfies the following equation (1):

$$QC \geqq 15.982 \times S^{-0.378} \quad (1)$$

wherein S represents a nominal speed of the photographic material, provided that $100 \leqq S \leqq 1600$; and QC represents a quality value and is defined as follows;

when a Macbeth color checker chart (having 24 colored squares including 6 neutral gray areas and 18 color areas) having been photographed with the photographic material using a camera under a light source having a color temperature of 4800° K at an under-exposure of 3 stops-down from normal exposure in which the aperture of the camera is reduced by 3 steps from the normal exposure and after having been processed, the photographic material is exposed to obtain a print under the exposure condition so that N5 gray of the Macbeth color checker chart (gray chart of 18% reflectance) gives values of $L^*=50$, $a^*=0$ and $b^*=0$ and 18 colors other than gray are subjected to chromaticity measurement, the quality value of QC is calculated according to the following equation (2):

$$QC=(Cr+Ch)/2 \quad (2)$$

wherein Cr and Ch are defined in the following equations (3) and (4):

$$Cr=20 \times \log_{10}(Cr0) \quad (3)$$

$$Ch=7.0-3 \times \log_{10}(Ch0) \quad (4)$$

wherein Cr0 represents a ratio of a mean chroma value calculated from chromaticity values of 18 colors of the Macbeth color checker chart to a mean chroma value calculated from chromaticity values of 18 colors of the print of the Macbeth color checker chart; and when from color vectors of the 18 colors of the Macbeth color checker chart and the respective color vectors of the print corresponding to the Macbeth color checker chart, chromaticity fluctuations for the respective colors are represented by an angle between the foregoing color vectors for each of the 18 colors, a mean value of the chromaticity fluctuations is designated as Ch0;

2. A silver halide photographic light sensitive material which is in the form of roll film packaged in a cartridge, comprising on a support a red-sensitive layer, a green-sensitive layer and a blue-sensitive layer, wherein the photographic material satisfies the following equation (5):

$$QT \geqq 11.544 \times S^{-0.2752} \quad (5)$$

wherein S represents a nominal speed of the photographic material, provided that $100 \leqq S \leqq 1600$; and QT represents a quality value and is defined by the following equation (6):

$$QT=(QC+QG)/2 \quad (6)$$

wherein QC is the same as defined in 1. above; and QG is defined as follows;

$$QG=(0.413 \times M^{-3.4}+0.422 \times R^{-3.4})^{-1/3.4}-0.53$$

wherein M and G are defined by the following equations:

$$M=7.0\times\log_{10}(Mg\times0.7+Mr\times0.3)-10 \quad (12)$$

$$Mg=Mg0\times\gamma g\times100 \quad (10)$$

$$Mr=Mr0\times\gamma r\times100 \quad (11)$$

wherein Mg0 and Mr0 are MTF values at a spatial frequency of 15 cycle/mm of magenta and cyan images obtained at normal exposure, respectively; when the photographic material is exposed at an under-exposure in which the aperture is reduced by 3 steps from the normal exposure and after being processed, the density of the area corresponding to a Neutral 5 (N5) gray area of the Macbeth Color Checker chart is determined, which is designated as $Dg_1$ and $Dr_1$ and when the photographic material is exposed and processed to prepare a characteristic curve comprised of an ordinate of density (D) and abscissa of exposure (logE) for each of magenta and cyan images, γg and γr are a slope (tanθ) of a straight line connecting two points corresponding $Dg_2$ and $Dg_3$ or $Dr_2$ and $Dr_3$ on the magenta or cyan characteristic curve is determined for magenta and cyan images, in which when an exposure at density $Dg_1$ or $Dr_1$ on the characteristic curve is designated as $logEg_1$ or $logEr_1$, $Dg_2$ and $Dr_2$ are respectively densities corresponding to exposures of $logEg_2=logEg_1-0.3$ and $logEr_2=logEr_1-0.3$ on the magenta and cyan characteristic curves, and $Dg_3$ and $Dr_3$ are respectively densities corresponding to exposures of $logEg_3=loggE_1+0.3$ and $logEr_3=loggrE_1+0.3$ on the characteristic curve;

$$R=(7\times Rg+4\times Rr)/11 \quad (9)$$

$$Rg=-7.0\times\log_{10}(3.4\times Rgav)+15.5 \quad (7)$$

$$Rr=-7.0\times\log_{10}(3.4\times Rrav)+15.5 \quad (8)$$

wherein Rgav is an average value of RMS granularities $RMSg_1$, $RMSg_2$ and $RMSg_3$ at densities $Dg_1$, $Dg_2$ and $Dg_3$ on the characteristic curve of the magenta image; and Rrav is an average value of RMS granularities $RMSr_1$, $RMSr_2$ and $RMSr_3$ at densities $Dr_1$, $Dr_2$ and $Dr_3$ on the characteristic curve of the cyan image;

3. A silver halide photographic light sensitive material which is in the form of a roll film packaged in a cartridge, comprising on a support a red-sensitive layer, a green-sensitive layer and a blue-sensitive layer, wherein the photographic material satisfies the following equation (14) and exhibits a cyan minimum density of less than 0.20 after having been processed:

$$QTN\geqq14.838\times S^{-0.274} \quad (14)$$

wherein S represents a nominal speed of the photographic material, provided that $100\leqq S\leqq1600$; and QTN represents a quality value and is defined by the following equation (15):

$$QTN=(QCN+QGN)/2 \quad (15)$$

wherein QCN is a value which is obtained similarly to the foregoing QC value, except that a Macbeth color checker chart (comprised of 24 colored squares) has been photographed with the photographic material using a light source having a color temperature of 4800° K at a normal exposure; and QGN is a value which is obtained similarly to the foregoing QG value, except that a Macbeth color checker chart (comprised of 24 colored squares) has been photographed with the photographic material using a light source having a color temperature of 4800° K at a normal exposure;

4. The silver halide photographic material described in 1. or 2., wherein the photographic material satisfies the following equation (14) and exhibits a cyan minimum density of less than 0.20 after having been processed;

5. The silver halide photographic material described in any of 1. through 4., wherein the photographic material satisfies the following equation (16):

$$B\leqq10-10^{(-0.005\times S+0.85)}$$

wherein B represents a total silver coverage, expressed in $g/m^2$; S represents a nominal speed of the photographic material, provided that $100\leqq S\leqq1600$;

6. The silver halide photographic material described in any of 1. through 5., wherein the photographic material contains an infrared dye having a main absorption at the wavelength of 700 to 1100 nm;

7. The silver halide photographic material described in any of 1 through 6., wherein the photographic material has a nominal speed of 100 to 400.

The inventors of this application have made studies in light of the problems described earlier and as a result of detailed analysis of density distribution of photographed scenes taken by general users, it was proved that in algorithm for exposure control at specified speed of a printer, normal exposure conditions were easily determined when color reproduction of under-exposed photographic material was higher than a given value for the film speed.

Efficient achievement of enhancement of image quality has been a proposition for years and development of a method thereof has been consistently desired. As a result of the inventors' study, it was further proved that a dominant factor of print quality of under-exposures was not only graininess but also when a quality value relating to color reproduction, QC value and a quality value (or QT value) including graininess and sharpness both of which were more than prescribed values, print quality was recognized as being superior; and the quality values depend of nominal speed of the used film. Thus, the present invention is presented based on the foregoing.

DETAILED DESCRIPTION OF THE INVENTION

One aspect of the invention is that a silver halide photographic light sensitive material, which is packaged in a cartridge in a roll form, comprising on a support a red-sensitive layer, a green-sensitive layer and a blue-sensitive layer, wherein the quality value QC, as defined earlier satisfies the equation (1).

The quality value, QC is a parameter indicating the extent of color balance of a finished print of an under-exposed scene, that is, print level variation.

As a result of the study of methods for decreasing print level variation of commercially available printers and enhancing finished print quality, it was proved that normal exposure conditions not being determined in the printer was a factor of increasing the print level variation. From analysis of a problem of finished print quality, it was further proved that low contrast of the obtained print image was a cause thereof.

However, allowing both problems described above to exist simultaneously means treating the under-exposed scene and the correctly exposed scene as the same characteristic, leading to an increase of the silver content of a photographic material for picture-taking (or camera material) and producing problems such as silver retention, increased fog density and increased cost, which are by no means effective. As a means for increasing contrast in the toe portion on a characteristic curve which is used in the under-exposed cameral material is cited a method of using large silver halide grains to increase the ISO speed. In fact, enhancing the effective speed in printing can be achieved to some extent; however, on the contrary, the use of large silver halide grains produces rough graininess of the subsequent printed image, often producing complaints of prints being unacceptable by the photographer. It was further proved that even if the effective speed was enhanced by the foregoing method, color contrast was insufficient and proper printing conditions could not be determined, which was not so effective to reduce the print level variation.

The invention was made in view of the foregoing problems. Thus, exposure conditions of a printer are set up, as follows: the overall exposure condition has been controlled up to now based on neutral densities so as to raise or lower the finished density. In the invention, when separated color densities, specifically those in under-exposures are different, a correction value is calculated and the relationship between quality value QC as the correction value and the nominal speed of the photographic material is specified to provide a print exhibiting a stable color balance even when photographed at an under-exposure. In the invention, quality value QC is represented by rounding a calculated value to one decimal.

According to equation (1) described above, the quality value QC relating to the invention is 2.8 or more for photographic material of the nominal speed of 100, 2.2 or more for photographic material of the nominal speed 200, 1.7 or more for photographic material of the nominal speed 400, 1.3 or more for photographic material of the nominal speed 800, and 1.0 or more for photographic material of the nominal speed 1600.

Unless satisfying the foregoing condition, determination of the proper density and calculation of printing conditions in cases when color temperature or background vary at the time of taking-picture cannot be definitely achieved, making it difficult to finish human skin color within acceptable levels of tolerance.

Next, quality value QC will be described. In the invention, the QC value satisfies the following equation:

$$QC \geqq 15.982 \times S^{-0.378} \quad (1)$$

wherein S represents a nominal speed of a photographic material, provided that $100 \leqq S \leqq 1600$; and QC is determined in accordance with the process comprising the steps of:

(i) photographing a Macbeth color checker chart which is a checkerboard array of 24 colored squares in a wide range colors (including 6 grades of neutral gray and 18 kinds of colors other than gray) with the photographic material under a light source having a color temperature of 4800° K using a camera at an under-exposure of 3 stops-down from normal exposure in which the aperture of the camera is reduced by 3 steps from that of the normal exposure;

(ii) processing the thus exposed photographic material in a prescribed color processing, for example, the process described in paragraph [0220]–[0227] of JP-A No. 10-123652, as described later;

(iii) printing the processed photographic material on a color paper to produce a color print, under such an exposure condition that an area on the print, corresponding to Neutral 5 (or N5) gray area of the Macbeth color checker chart (which is a neutral gray area exhibiting a reflectance of 18%) gives values of L*=50, a*=0 and b*=0, (iv) subjecting the color print to chromaticity measurement to determine chroma values of areas on the print corresponding to 18 colors other than the 6 grades of gray of the Macbeth color checker chart, and (v) calculating the foregoing QC value according to the following equation (2):

$$QC=(Cr+Ch)/2 \quad (2)$$

wherein Cr and Ch are defined in the following equations (3) and (4):

$$Cr=20\times\log_{10}(Cr0) \quad (3)$$

$$Ch=7.0-3\times\log_{10}(Ch0) \quad (4)$$

wherein Cr0 is the ratio of the mean value of chroma values of 18 colors of the Macbeth color checker chart to the mean value of chroma values of the areas on the print corresponding to the 18 colors of the Macbeth color checker chart; and the absolute value of the difference in angle between a color vector of each of the 18 colors of the Macbeth color checker chart and that of an area on the print corresponding to each of the 18 colors is determined and the average value of the thus determined absolute values of the 18 colors is defined as Ch0.

In the invention, the L*, a* and b* values are color coordinates represented by CIE 1976 (L*, a*, b*) space, and calorimetric calculation is made using standard light source C as an observation light to obtain tristimulus values. The L*, a* and c* values are commonly known in the art, as described, for example, in U.S. Pat. No. 5,362,616, and can also be determined by the method described in "Shikisai Kagaku Handbook (New Edition)", pages 83–146, 182–255 (edited by Nippon Shikisai-Gakkai, published by Tokyo Daigaku Shuppankai). Thus, chromaticity of a photographic material for camera use is measured using a color analyzer (e.g., CMS-1200, produced by Murakami Shikisai Co., Ltd.) and the chromaticity point in the L*a*b* space is determined using a color matching function at a visual field of 2° and a standard light source, C light source.

The nominal speed, designated as "S", refers to a numeral indicated subsequent to designation "ISO" on the outside of a cartridge (or patrone) or a vessel having photographic film of commonly known 135 size, IV 240 Type and the like. Alternatively, on the outer surface of the metallic container of 135 size roll film (also called cartridge), a portion comprised of a conductive section and non-conductive section, so-called CAS portion is provided to detect the film speed, and the nominal speed is a speed value indicated when the cartridge is loaded in a camera. Speed of photographic material is represented in various ways in different countries. The nominal speed in the invention (designated as "S") is expressed in ISO speed, which is used as an international designation. In the case of the ISO speed designation being 100/21°, the ISP speed is to be 100. In the invention, S is not less than 100 and not more than 1600, and preferably not less than 100 and not more than 400.

The normal exposure in general refers to the exposure condition which can be determined by means of a commercially available exposure meter, in which the film speed, and the aperture (stop) and shutter speed (exposure time) in photographing (picture-taking). The designated values therein are often determined based on N5 gray chart (of Macbeth color checker chart), exhibiting 18% reflectance. In this invention, the normal exposure is defined as an exposure amount of 10/S lx·sec, where S is the nominal speed. In the case of the film speed of 100, for example, the normal exposure is to be the exposure condition giving an exposure amount of 0.10 lx·sec. Furthermore, as described earlier, expression "having been photographed at an under-exposure of 3 stops-down from normal exposure in which the aperture of the camera is reduced by 3 steps from the normal exposure" means that photographic is performed in an exposure amount of ⅛ of the normal exposure amount, as defined above.

One aspect of this invention is that a silver halide photographic light sensitive material which is in the form of a roll film packaged in a cartridge, comprising on a support a red-sensitive layer, a green-sensitive layer and a blue-sensitive layer, wherein the quality value QT, as defined earlier satisfies the equation (5). The quality value QT is a parameter indicating image quality of a print, that is, graininess and sharpness of an underexposed scene.

It is generally said that sharpness and graininess affect image quality of finished prints. It is really difficult to achieve an appropriate image quality design at the same level as the normal exposure region and it is the status quo that effective means therefore are few. As described earlier, deteriorated contrast is cited as print quality of under-exposures. Specifically, from reflection density and visual assessment values of graininess and image quality of finished prints, it was proved that image quality of under-exposed scenes was affected by color reproduction to a greater extent than that of normally exposed scenes. It was further proved that a product of RMS granularity as a barometer of graininess, MTF as a barometer of sharpness and neutral contrast was also an important factor. It was found that the object of the invention was achieved when the quality value QT which was determined by the contrast of an under-exposed scene, QG approximated by a hyperbolic curve having a parameter of graininess and color space of the QC value described earlier, and the nominal speed of a photographic material meet the relationship represented by equation (5). In this invention, the QT value was rounded to one decimal.

According to the equation (5) described earlier, the preferred quality value QT relating to the invention is 3.3 or more for photographic material of the nominal speed of 100, 2.7 or more for photographic material of nominal speed 200, 2.2 or more for photographic material of nominal speed 400, 1.8 or more for photographic material of nominal speed 800, and 1.5 or more for photographic material of nominal speed 1600.

It is unclear problems in the design of a photographic material for camera use that how graininess, sharpness, contrast and color reproduction are balanced to obtain a best print and therefore, extensive trial and error experimentation was conducted to achieve optimum design. Development of silver halide photographic materials optimized to the respective nominal speeds can be efficiently achieved by advancing design based on the quality value QT relating to this invention, thereby leading to enhanced image quality of finished prints.

Next, the quality value QT will be detailed. In the invention, the photographic material satisfies the following equation (5):

$$QT \geqq 11.544 \times S^{-0.2752} \quad (5)$$

wherein S represents the nominal speed of the photographic material for camera use, provided that $100 \leqq S \leqq 1600$; and QT represents the quality value and is defined by the following equation (6):

$$QT = (QC + QG)/2 \quad (6)$$

In the equation (6), QC is the same as quality value QC as described earlier and QG is defined as follows;

when a Macbeth color checker chart (comprised of 24 colored squares) has been photographed with the photographic material using a camera under a light source having a color temperature of 4800° K at an under-exposure of 3 stops-down from the normal exposure in which the aperture of the camera is reduced by 3 steps from the normal exposure and after processing the photographic material, the density of the area corresponding to a Neutral 5 (N5) gray area of the Macbeth Color Checker chart is designated as $D_1$ (or $Dg_1$ and $Dr_1$ for magenta and cyan densities, respectively). Separately, the photographic material is exposed and processed to prepare a characteristic curve for each of magenta and cyan dye images. The characteristic curve, as is well known in the art, is comprised of ordinate of density (designated as D) and abscissa of logarithmic exposure (designated as logE). A granularity at the density of $D_1$ (or $Dg_1$ and $Dr_1$) is determined and designated as $RMS_1$ (or $RMSg_1$ and $RMSr_1$). When an exposure at density $D_1$ on the characteristic curve (or densities $Dg_1$, and $Dr_1$ on the magenta and cyan characteristic curves) is designated as $logE_1$ ($logEg_1$ and $logEr_1$), a granularity at a density $D_2$ corresponding to an exposure of $logE_2 = logE_1 - 0.3$ on the characteristic curve is determined and designated as $RMS_2$ (or $RMSg_2$ and $RMSr_2$), and a granularity at a density $D_3$ corresponding to an exposure of $logE_3 = logE_1 + 0.3$ on the characteristic curve is determined and designated as $RMS_3$ (or $RMSg_3$ and $RMSr_3$), the average value of granularities at the foregoing three densities ($Dg_1$, $Dg_2$ and $Dg_3$) on the characteristic curve of a magenta dye image is determined and designated as Rgav; and the average value of granularities at the foregoing three densities ($Dr_1$, $Dr_2$ and $Dr_3$) on the characteristic curve of a cyan dye image is designated as Rrav; Rg and Rr are determined by the following equations (7) and (8):

$$Rg = -7.0 \times \log_{10}(3.4 \times Rgav) + 15.5 \quad (7)$$

$$Rr = -7.0 \times \log_{10}(3.4 \times Rrav) + 15.5 \quad (8)$$

A characteristic curve can be prepared in the following manner. A photographic material for camera use is exposed to light for 1/200 sec. through an optical wedge using light source having a color temperature of 4800° K and processed, for example, according to the process described in JP-A No. 10-123652, col. [0220] through [0227] and the processed photographic material is subjected to densitometry using a densitometer, for example, a densitometer produced by X-rite Co. to prepare characteristic curves comprised of an ordinate of density (D) and an abscissa of logarithmic exposure (logE) for yellow, magenta and cyan images, respectively. Specifically, the density at a portion in the processed photographic material, which corresponds to the Neutral 5 (N5 gray) square in the Macbeth Color Checker chart is measured to obtain density $D_1$ and the RMS granularity at density $D_1$ is determined and designated as $RMS_1$. Furthermore, when exposure (logE) corresponding to density $D_1$ on the characteristic curve as obtained above is designated as $logE_1$, RMS granularities at exposures of $logE_2 = logE_1 - 0.3$ and $logE_3 = logE_1 + 0.3$ on the characteristic curve are determined, which are designated as $RMS_2$ and $RMS_3$, respectively, and which are determined for each of magenta and cyan dye images.

The granularity (RMS) is measured in such a manner that densitometry is made by scanning with a microdensitometer at an aperture area of 750 $\mu m^2$ (a 5 $\mu$m wide, 150 $\mu$m long slit) and 1000 times a standard deviation of density variation of at least 1000 densitometry samples is defined as a RMS value of this invention. Magenta and cyan densities are measured using Wratten filters W-99 and W-20 (available from Eastman Kodak Co.), respectively.

From the thus obtained Rg and Rr values, R is determined in accordance with the following equation (9):

Equation (9)

$$R=(7\times Rg+4\times Rr)/11 \quad (9)$$

Next, MTF values at a spatial frequency of 15 cycle/mm of magenta and cyan images obtained at normal exposure are designated as Mg0 and Mr0, respectively. Thus, the photographic material is exposed to light through a pattern wedge for MTF measurement and after being processed, the photographic material is subjected to densitometry using a microdensitometer to determine MTF values at a spatial frequency of 15 cycle/mm of magenta and cyan images obtained under the normal exposure.

Further, slope (tanθ) of a straight line connecting two points corresponding $D_2$ ($Dg_2$ or $Dr_2$) $D_3$ ($Dg_3$ or $Dr_3$) on the foregoing characteristic curve is determined for magenta and cyan images and designated as γg and γr. Thus, when the density at the portion corresponding to N5 gray (or Neutral 5) of the Macbeth color checker chart is designated as $D_1$ and an exposure at density $D_1$ on the characteristic curve is designated as $\log E_1$, $D_2$ and $D_3$ are densities corresponding to exposures of $\log E_2=\log E_1-0.3$ and $\log E_3=\log E_1+0.3$ on the characteristic curve, respectively. Furthermore, using the foregoing values Mg0, Mr0, γg and γr, Mg and Mr are determined in accordance with the following equations (10) and (11):

$$Mg=Mg0\times\gamma g\times 100 \quad (10)$$

$$Mr=Mr0\times\gamma r\times 100 \quad (11)$$

Furthermore, M is determined in accordance with the following equation (12):

$$M=7.0\times\log_{10}(Mg\times 0.7+Mr\times 0.3)-10 \quad (12)$$

Measurement of the MTF value is commonly known and can readily be made. Details thereof, including the principle and method of the measurement, calculation equations and meaning as a photographic image are described in, for example, "Shashin-Kogaku no Kiso of Gineneshashin" (Fundamentals of Photographic Engineering of Silver Salt Photography, published by Corona Publishing Co.) on page 414–421.

Using the thus obtained M and R, QG is calculated in accordance with the following equation (13):

$$QG=(0.413\times M^{-3.4}+0.422\times R^{-3.4})^{-1/3.4}-0.53 \quad (13)$$

In one preferred embodiment of this invention, a silver halide photographic light sensitive material which is packaged in a roll form in a cartridge, comprising on a support a red-sensitive layer, a green-sensitive layer and a blue-sensitive layer is characterized in that quality value QTN described earlier satisfies equation (14) and the minimum cyan density of the processed photographic material is less than 0.20. The quality value QTN is a barometer representing relationship of graininess, sharpness and color reproduction in the normal exposure region, specifically concerning scanner suitability for backlight scenes in digital printers or hybrid printers.

Next, improvements of graininess and contrast in backlight scenes, when using digital or hybrid printers will be described.

As a result of analysis of negative film picture-taken by amateur photographers, it was proved that when compressing or quantizing information at densities up to 3.5 (or gradation of more than 300 levels) to an image in the standard format having gradation of 256 levels, part of the information was not properly transformed. Specifically, transformation of low contrast scenes such as under-exposed scenes or backlight scenes to a proper contrast disadvantageously results in deteriorated image quality.

This was partially due to sharpness and graininess in normal exposures, and it was proved to be necessary to make correction of color information of negative film in contrast transformation to inhibit excessive transformation. As a result, it was concluded that chroma of blue, green and red densities and hue reproduction are significant to inhibit excessive transformation in negative film, and unless both, chroma and density fall within the specific range, contrast transformation in quantization of respective densities at the time when printer software computes the average density unnecessarily modulates contrast of silver halide photographic material. Thus, it was proved that the foregoing problems could be overcome by setting the QTN quality value and the nominal speed of photographic material for camera use so as to meet the relationship defined in equation 14.

According to equation (14) described below, the quality value, QTN is preferably 4.2 or more for photographic material of the nominal speed of 100, 3.5 or more for photographic material of the nominal speed 200, 2.9 or more for photographic material of the nominal speed 400, 2.4 or more for photographic material of the nominal speed 800, and 2.0 or more for photographic material of the nominal speed 1600.

This was proved to be due to the fact that photographic color film usually has a minimum density (corresponding to a mask density) and unnecessary data in the minimum density area affect digital quantization of uncompressed analog information.

Analysis of effects of respective mask densities on blue, green and red densities revealed that the respective mask densities affected images substantially at an equal level. It was further proved that when the minimum red density is less than 0.2 to reproduce flesh tone, the combination of the QTN value therewith results in prints with natural contrast in the normal exposure region and superior graininess even when employing functions such as local printing in digital prints.

Next, quality value QTN relating to this invention will be detailed below. The quality value QTN is represented by the following equation (14):

$$QTN\geqq 14.838\times S^{-0.274} \quad (14)$$

wherein S is a nominal speed, provided that $100\leqq S\leqq 1600$; and QTN is defined by the following equation (15):

$$QTN=(QCN+QGN)/2 \quad (15)$$

wherein QCN is the same as defined earlier, except that a Macbeth color checker chart (comprised of 24 varyingly colored squares) is photographed at a normal exposure with the photographic material using a light source having a color temperature of 4800° K; and QGN is the same as defined earlier, except that a Macbeth color checker chart (comprised of 24 colored squares) is photographed at a normal exposure with the photographic material using a light source having a color temperature of 4800° K.

In one preferred embodiment of this invention, the total silver coverage, which is represented as calculated in terms of silver (i.e., coating weight of silver), is the silver content, B ($g/m^2$) meeting the following equation (16):

$$B \leqq 10.0 - 10^{(-0.005 \times S + 0.85)} \quad (16)$$

wherein S is a nominal speed, provided $100 \leqq S \leqq 1600$.

When the content of silver used in a photographic material and the nominal speed of the photographic material meet the foregoing equation (16), the state of speed and the state of image quality of the photographic material are optimized and optimizing desilvering ability in various processes leads to an enhanced S/N ratio in negative to positive conversion of negative film at the stage of digital printing.

According to equation (16), silver content B is 3.4 ($g/m^2$) or less for photographic material of the nominal speed of 100, 3.8 ($g/m^2$) or less for photographic material of nominal speed 200, 4.6 ($g/m^2$) or less for photographic material of nominal speed 400, 5.9 ($g/m^2$) or less for photographic material of nominal speed 800, and 7.7 ($g/m^2$) or less for photographic material of nominal speed 1600.

In one preferred embodiment of this invention, the silver halide photographic material relating to the invention contains an infrared absorbing dye having its main absorption at wavelengths of 700 to 1100 nm. Thus, the infrared transmission density is preferably increased in the photographic material relating to this invention, whereby positioning for individual pictures, for example, scenes taken by film with lens or a low price camera can be precisely conducted at the stage of scanning processed negative film and image processing is conducted without reading a portion not relevant to the real scene (minimum density) to perform positive image processing by effectively using the dynamic range of positive image data (8 to 16 bits), leading to finished prints having superior (not unpleasant) contrast, which is close to that performed by an analog printer.

Any infrared absorbing dye having an absorption maximum within the wavelength region of 700 to 1100 nm is applicable to this invention. Such infrared absorbing dyes have been used in infrared-recording silver halide photographic material, semiconductor laser, optical filter, LB membranes, photoelectric conversion, and vinyl resin structures in agricultural application. Examples of specific infrared dyes include cyanine type dyes, methine type dyes, quinone type dyes, naphthoquinone type dyes, quinonediimine type dyes, phthalocyanine type dyes and 1,2-dithiol complex type dyes.

Cyanine Dye

Cyanine type near-infrared absorbing dyes useable in this invention preferable are compounds represented by the following formula (1) or (3):

Formula (1)

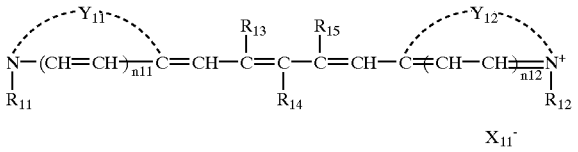

Formula (3)

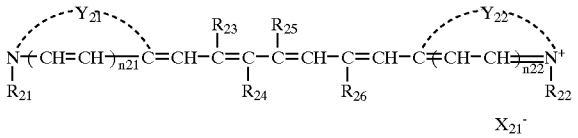

In the formula, $Y_{11}$, $Y_{12}$, $Y_{21}$, and $Y_{22}$ are each independently an non-metallic atom group necessary to form a 5- or 6-membered nitrogen-containing heterocyclic ring, such as a benzothiazole ring, naphthothiazole ring, benzoselenazole ring, naphthoselenazole ring, benzoxazole ring, naphthoxazole ring, quinoline ring, 3,3-dialkylindolenine ring, benzimidazole ring and pyridine ring. The heterocyclic ring may be substituted by substituent groups such as low alkyl group, alkoxy group, hydroxy group, aryl group, alkoxycarbonyl group and halogen atom. $R_{11}$, $R_{12}$, $R_{21}$ and $R_{22}$ are each independently a substituted or unsubstituted alkyl aryl or aralkyl group. $R_{13}$, $R_{14}$, $R_{15}$, $R_{23}$, $R_{24}$, $R_{25}$, and $R_{26}$ are each independently a substituted or unsubstituted alkyl, alkoxy, phenyl, benzyl group or —N<$W_1W_2$, in which $W_1$ and $W_2$ are each a substituted or unsubstituted alkyl (comprised of an alkyl portion having 1 to 18, and preferably 1 to 4 carbon atoms) or aryl group, provided that $W_1$ and $W_2$ may be linked together with each other to a 5- or 6-membered nitrogen containing heterocyclic ring. $R_{13}$ and $R_{15}$, or $R_{23}$ and $R_{25}$ may be linked together with each other to form a 5- or 6-membered ring. $X_{11}^-$ and $X_{21}^-$ are each an anion; n11, n12, n21 and n22 are each 0 or 1.

Representative examples of the compounds represented by formula (1) or (3) are shown below, but the present invention is by no means limited to these compounds.

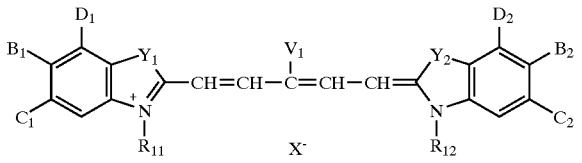

| Example No. | $Y_1$ | $Y_2$ | $B_1$ | $C_1$ | $B_2$ | $C_2$ | $R_{11}$ | $R_{12}$ | $V_1$ | $X^-$ | $D_1$ | $D_2$ |
|---|---|---|---|---|---|---|---|---|---|---|---|---|
| 1-1 | Se | Se | H | H | H | H | $C_2H_5$ | $C_2H_5$ | H | I | H | H |
| 1-2 | S | S | H | H | H | H | $C_2H_5$ | $C_2H_5$ | H | I | H | H |
| 1-3 | Se | Se | H | H | H | H | $(CH_2)_2OCH_3$ | $(CH_2)_2OCH_3$ | H | Br | H | H |
| 1-4 | Se | S | H | H | H | H | $(CH_2)_3SO_3H$ | $C_2H_5$ | H | — | H | H |
| 1-5 | S | S | H | $OCH_3$ | H | H | $C_2H_5$ | $C_2H_4OH$ | $C_2H_5$ | Br | H | H |
| 1-6 | S | S | $C_2H_5$ | H | $C_2H_5$ | H | $C_5H_{11}$ | $C_5H_{11}$ | $C_2H_5$ | Br | H | H |
| 1-7 | S | S | $C_2H_5$ | H | $C_2H_5$ | H | $C_5H_{11}$ | $C_5H_{11}$ | $C_4H_9$ | Br | H | H |
| 1-8 | S | S | $OCH_3$ | $OCH_3$ | $OCH_3$ | $OCH_3$ | $C_2H_5$ | $C_2H_5$ | $CH_3$ | I | H | H |

-continued

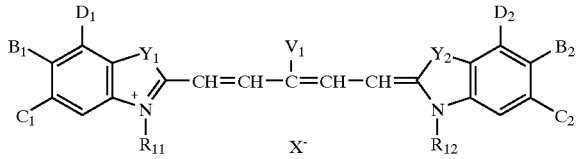

| Example No. | $Y_1$ | $Y_2$ | $B_1$ | $C_1$ | $B_2$ | $C_2$ | $R_{11}$ | $R_{12}$ | $V_1$ | $X^-$ | $D_1$ | $D_2$ |
|---|---|---|---|---|---|---|---|---|---|---|---|---|
| 1-9 | S | S | $OCH_3$ | H | $OCH_3$ | H | $C_2H_5$ | $C_2H_5$ | H | I | $OCH_3$ | $OCH_3$ |
| 1-10 | S | S | $OCH_3$ | H | $OCH_3$ | H | $CH_2CH{=}CH_2$ | $CH_2CH{=}CH_2$ | H | I | $OCH_3$ | $OCH_3$ |
| 1-11 | S | S | $OCH_3$ | H | $OCH_3$ | H | $CH_2CH{=}CH_2$ | $CH_2CH{=}CH_2$ | $C_2H_5$ | Br | $OCH_3$ | $OCH_3$ |

1-12

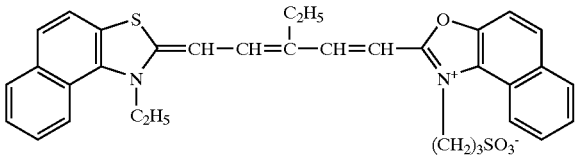

1-13

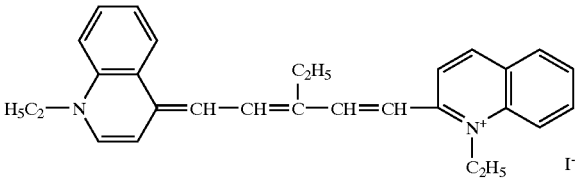

1-14

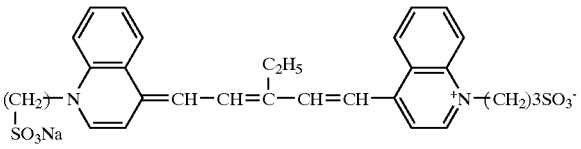

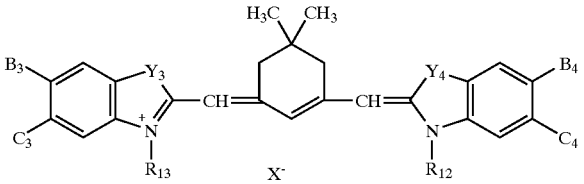

| Example No. | $Y_3$ | $Y_4$ | $B_3$ | $C_3$ | $B_4$ | $C_4$ | $R_{13}$ | $R_{14}$ | — |
|---|---|---|---|---|---|---|---|---|---|
| 2-1 | S | S | H | H | H | H | $C_2H_5$ | $C_2H_5$ | Br |
| 2-2 | S | S | $CH_3$ | H | H | H | $C_2H_5$ | $C_2H_5$ | Br |
| 2-3 | S | S | $CH_3$ | H | $CH_3$ | H | $C_2H_5$ | $C_2H_5$ | I |
| 2-4 | S | S | H | H | H | H | $C_2H_5$ | $C_3H_7$ | I |
| 2-5 | S | S | H | H | H | H | $C_2H_5$ | $C_4H_9$ | I |
| 2-6 | S | S | H | H | H | H | $C_2H_5$ | $C_5H_{11}$ | Br |
| 2-7 | S | S | H | H | H | H | $C_2H_5$ | $C_7H_{15}$ | Br |
| 2-8 | S | S | H | H | H | H | $C_2H_5$ | $C_{10}H_{21}$ | Br |
| 2-9 | S | S | H | H | H | H | $C_3H_7$ | $C_3H_7$ | Br |

-continued

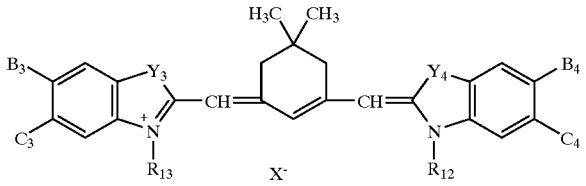

| Example No. | $Y_3$ | $Y_4$ | $B_3$ | $C_3$ | $B_4$ | $C_4$ | $R_{13}$ | $R_{14}$ | — |
|---|---|---|---|---|---|---|---|---|---|
| 2-10 | S | S | H | H | H | H | $C_4H_9$ | $C_4H_9$ | $PTS^{-*}$ |
| 2-11 | S | S | H | H | H | H | $C_5H_{11}$ | $C_5H_{11}$ | Br |
| 2-12 | S | S | H | H | H | H | $C_7H_{15}$ | $C_7H_{15}$ | Br |
| 2-13 | S | S | $CH_3$ | H | H | H | $C_2H_5$ | $C_5H_{11}$ | Br |
| 2-14 | S | S | $CH_3$ | H | $CH_3$ | H | $C_2H_5$ | $C_5H_{11}$ | Br |
| 2-15 | S | S | $OCH_3$ | H | H | H | $C_2H_5$ | $C_2H_5$ | Br |
| 2-16 | S | S | $OCH_3$ | H | H | H | $C_2H_5$ | $C_5H_{11}$ | Br |
| 2-17 | S | S | $CH_3$ | $CH_3$ | $CH_3$ | $CH_3$ | $C_2H_5$ | $C_2H_5$ | Br |
| 2-18 | S | S | $C_3H_7$(i) | H | $C_3H_7$(i) | H | $C_2H_5$ | $C_2H_5$ | Br |
| 2-19 | S | S | H | H | H | H | $C_2H_5$ | $(CH_2)_3SO_3^-$ | — |
| 2-20 | S | S | $CH_3$ | H | $CH_3$ | H | $C_2H_5$ | $(CH_2)_4SO_3^-$ | — |
| 2-21 | S | S | $CH_3$ | H | $CH_3$ | H | $(CH_2)_3SO_3HN(C_2H_5)_3$ | $(CH_2)_3SO_3^-$ | — |
| 2-22 | S | S | H | H | H | H | $C_2H_5$ | $(CH_2)_4SO_3^-$ | — |
| 2-23 | S | S | $CH_3$ | H | $CH_3$ | H | $C_2H_5$ | $C_5H_{11}$ | Br |
| 2-24 | Se | Se | H | H | H | H | $C_2H_5$ | $C_2H_5$ | Br |
| 2-25 | Se | Se | $CH_3$ | H | $CH_3$ | H | $C_2H_5$ | $C_2H_5$ | Br |

(*PTS: p-toluenesulfonic acid)

2-26

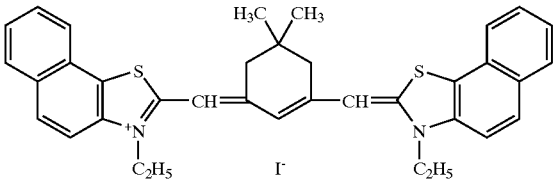

2-27

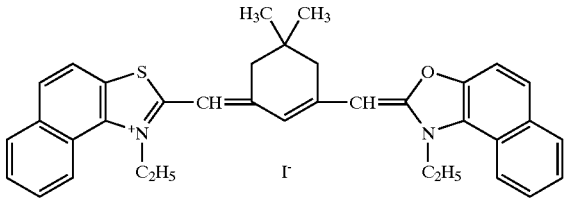

3-1

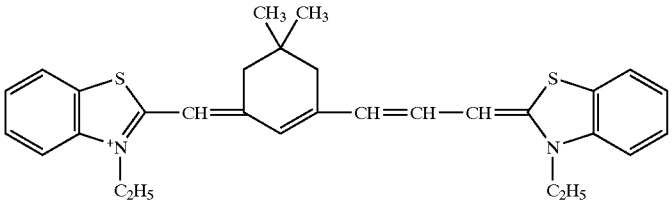

3-2

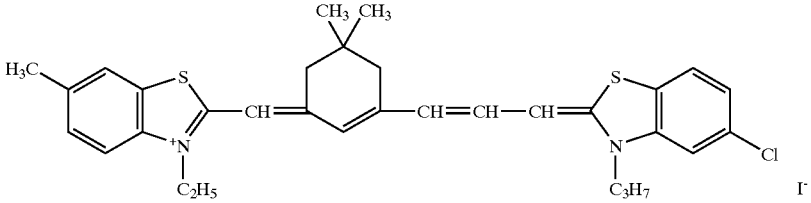

3-3

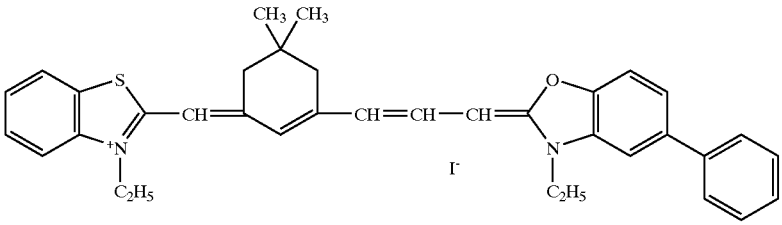

-continued
3-4
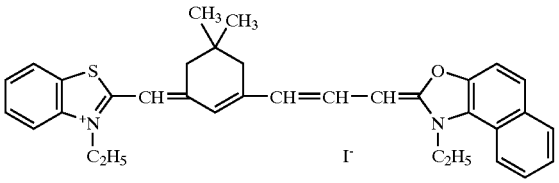
3-5
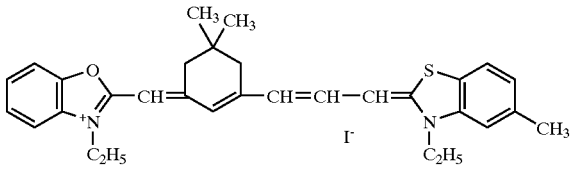
3-6
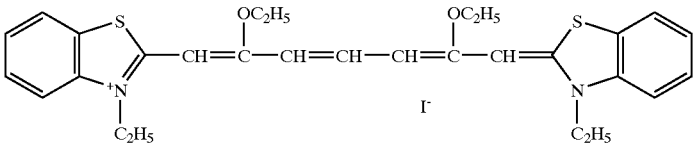
3-7
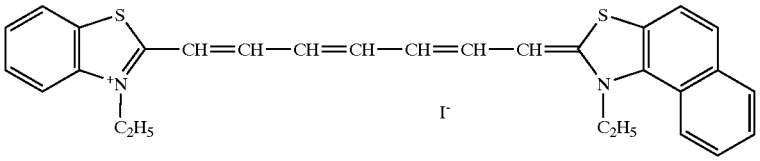
3-8
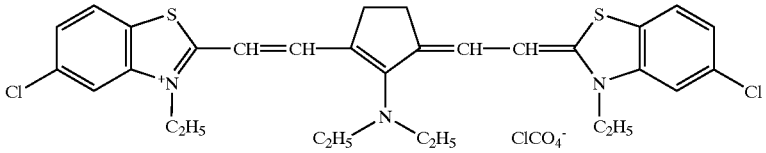
3-9
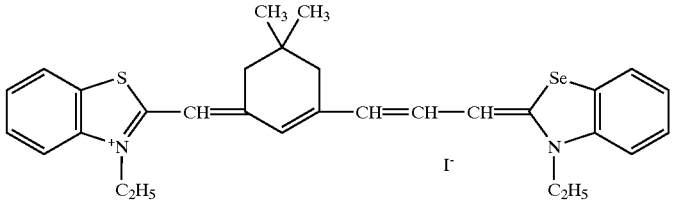
3-10
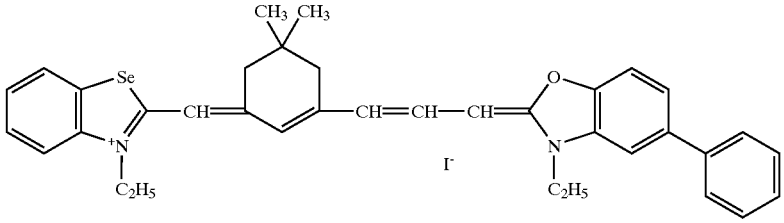
3-11
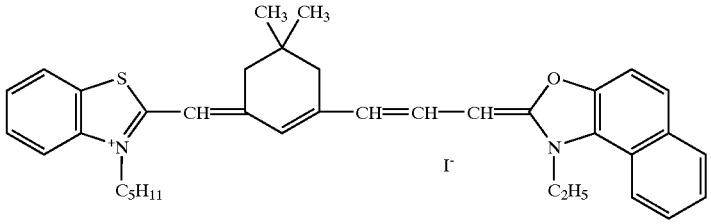
3-12
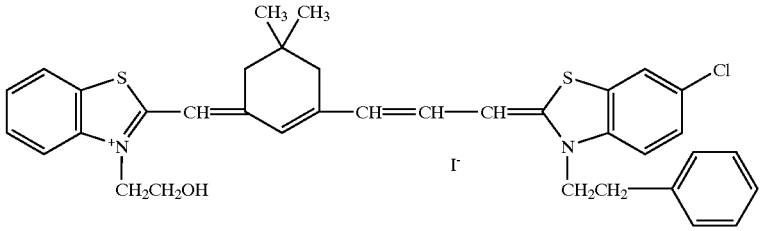

-continued
3-13
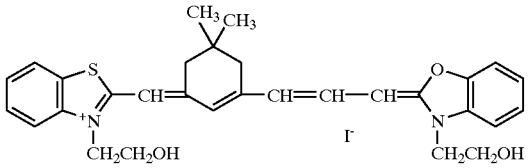
3-14
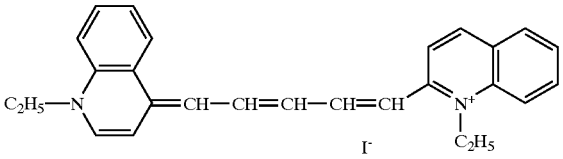
3-15
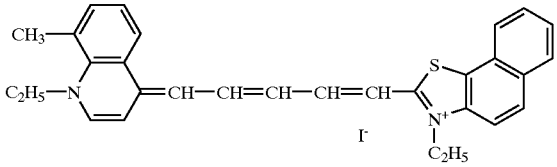
3-16
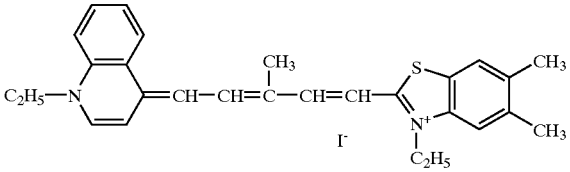
3-17
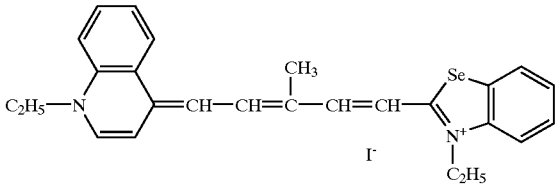
3-18
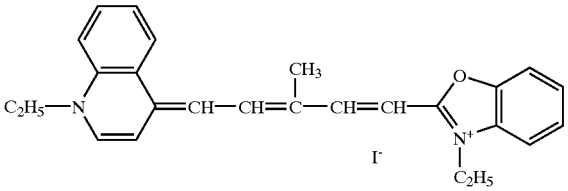
3-19
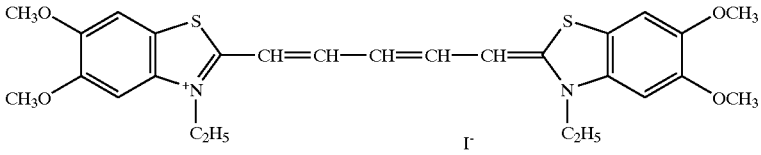
3-20
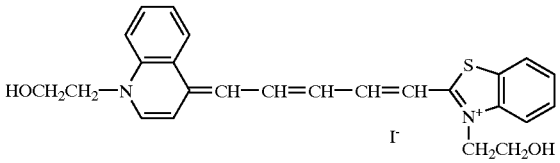
3-21
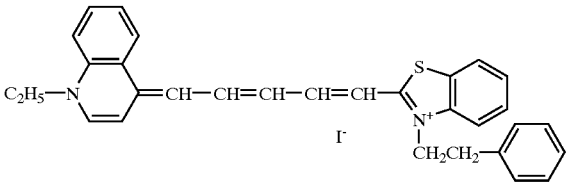
3-22
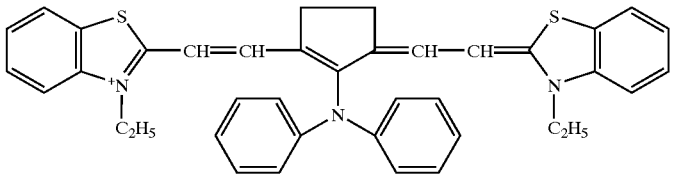
3-23
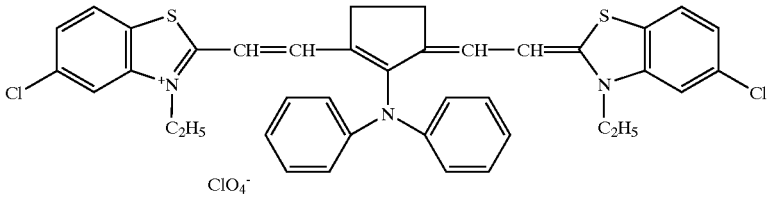
3-24
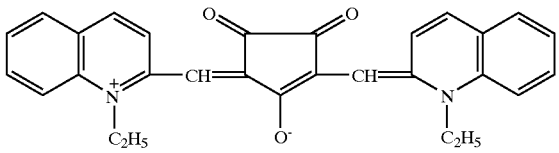
3-25
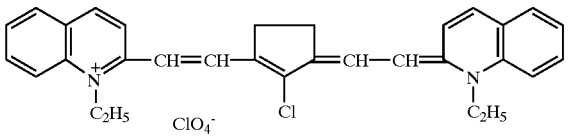

-continued 3-26

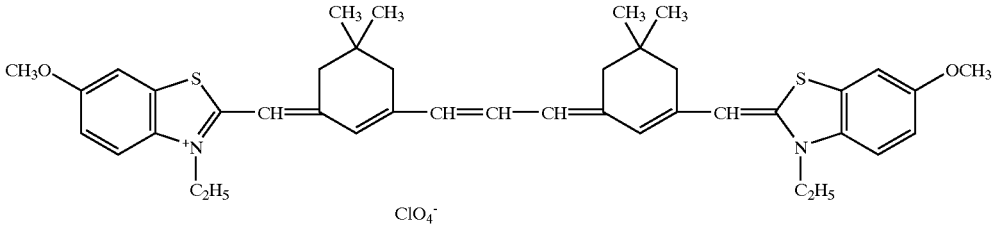

3-27

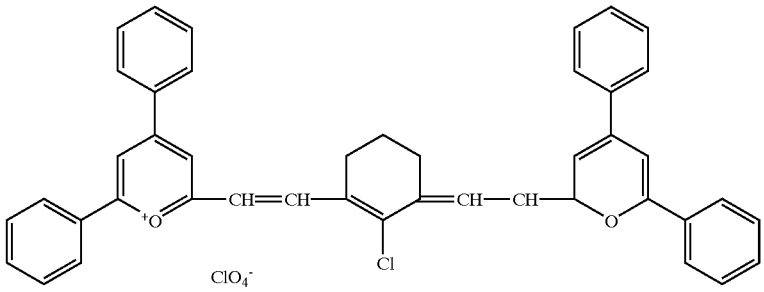

The foregoing infrared absorbing dyes can be readily synthesized in accordance with methods described in F. M. Hamer, The Chemistry of Heterocyclic Compounds, vol. 18, The CYanine Dyes and Related Compounds (A. Weissberger ed., Interscience, New York, 1964).

Next, silver halide photographic materials relating to this invention will be described.

As silver halide grains used in the silver halide photographic material of this invention, tabular silver halide grains having an aspect ratio of 8 or more, which account for at least 50% of the total grain projected are preferably used to achieve enhanced sensitivity and superior image quality. Tabular grains having an aspect ratio of 15 or more and accounting for at least 15% of the total grain projected area are specifically preferred.

In the photographic materials relating to the invention are usable silver halide emulsions described in Research Disclosure NO. 308119 (hereinafter, also denoted simply as RD308119). Relevant portions are shown below.

| Item | RD 308119 |
|---|---|
| Iodide composition | 993, I-A |
| Preparation method | 993, I-A; 994, I-E |
| Crystal habit (regular crystal) | 994, I-E |
| Crystal habit (twinned crystal) | 993, I-E |
| Epitaxial | 993, I-E |
| Homogeneous halide composition | 993, I-B |
| Inhomogeneous halide composition | 993, I-B |
| Halide conversion | 994, I-C |
| Halide substitution | 994, I-C |
| Metal occlusion | 994, I-D |
| Monodispersibility | 995, I-F |
| Solvent addition | 995, I-F |
| Latent image forming site (surface) | 995, I-G |
| Latent image forming site (internal) | 995, I-G |
| Photographic material (negative) | 995, I-H |
| Photographic material (positive, including internally fogged grains) | 995, I-H |
| Emulsion blending | 995, I-I |
| Desalting | 995, II-A |

Silver halide emulsions according to the invention are subjected to physical ripening, chemical ripening and spectral sensitization. As additives used in these processes are shown compounds described in Research Disclosure RD 17643, RD 18716 and RD 308119), as below.

| Item | RD 308119 | RD 17643 | RD 18716 |
|---|---|---|---|
| Chemical Sensitizer | 996, III-A | 23 | 648 |
| Spectral Sensitizer | 996, IV-A-A, B, C, D, H, I, J | 23–24 | 648–9 |
| Super Sensitizer | 996, IV-A-E, J | 23–24 | 648–9 |
| Antifoggant | 998, VI | 24–25 | 649 |
| Stabilizer | 998, VI | 24–25 | 649 |

Photographic additives usable in the invention are also described, as shown below.

| Item | RD 308119 | RD 17643 | RD 18716 |
|---|---|---|---|
| Anti-staining Agent | 1002, VII-I | 25 | 650 |
| Dye Image-Stabilizer | 1001, VII-J | 25 | |
| Britening Agent | 998, V | 24 | |
| U.V. Absorbent | 1003, VIII-C, XIII-C | 25–26 | |
| Light Absorber | 1003, VIII | 25–26 | |
| Light-Scattering Agent | 1003, VIII | | |
| Filter Dye | 1003, VIII | 25–26 | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricant | 1006, XII | 27 | 650 |
| Matting Agent | 1007, XVI | | |
| Developing Agent (incorporated in photographic material) | 1001, XXB | | |

A variety of couplers can be employed in the invention and examples thereof are described in research Disclosures described above. Relevant description portions are shown below.

| Item | RD 308119 | RD 17643 |
|---|---|---|
| Yellow coupler | 1001, VII-D | VII-C~G |
| Magenta coupler | 1001, VII-D | VII-C~G |
| Cyan coupler | 1001, VII-D | VII-C~G |
| Colored coupler | 1002, VII-G | VII-G |
| DIR coupler | 1001, VII-F | VII-F |
| BAR coupler | 1002, VII-F | |
| PUG releasing coupler | 1001, VII-F | |
| Alkali-soluble coupler | 1001, VII-E | |

Additives used in the invention can be added by dispersion techniques described in RD 308119 XIV. In the invention are employed supports described in RD 17643, page 28; RD 18716, page 647–648; and RD 308119 XIX. There are also employed polyester supports described in JP-A No. 6-102623 and 7-306496. In the photographic material relating to the invention, there can be provided auxiliary layers such as a filter layer and interlayer, as described in RD 308119 VII-K, and arranged in a variety of layer orders such as normal layer order, reverse layer order and a unit layer arrangement.

The photographic material relating to this invention can be processed using commonly known developers described in T. H. James "The Theory of The Photographic Process" Forth Edition, pp. 291–334; and J. Am. Chem. Soc. Vol. 73, pp. 3100 (1951), according to the conventional methods, as described in, cited above, RD38957, items XVII through XX and RD40145, item XXII.

EXAMPLES

The present invention will be further described, based on examples, but the invention is by no means limited to these embodiments.

Example 1

Preparation of Sample 101

On a 120 $\mu$m thick, subbed triacetyl cellulose film support, the following layers having composition as shown below were formed to prepare a multi-layered color photographic material sample 101. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol.

| 1st Layer: Anti-Halation Layer | |
|---|---|
| Black colloidal silver | 0.13 |
| UV-1 | 0.30 |
| CM-1 | 0.11 |
| OIL-1 | 0.23 |
| Gelatin | 1.20 |
| **2nd Layer: Interlayer** | |
| OIL-3 | 0.267 |
| Gelatin | 0.89 |
| **3rd Layer: Low-speed Red-sensitive Layer** | |
| Silver iodobromide emulsion a | 0.31 |
| Silver iodobromide emulsion k | 0.22 |
| SD-1 | $1.28 \times 10^{-4}$ |
| SD-2 | $1.78 \times 10^{-5}$ |
| SD-3 | $8.40 \times 10^{-5}$ |
| C-1 | 0.324 |
| CC-1 | 0.056 |
| D-1 | 0.014 |
| AS-2 | 0.002 |
| OIL-4 | 0.320 |
| Gelatin | 1.06 |
| **4th Layer: Medium-speed Red-sensitive Layer** | |
| Silver iodobromide emulsion j | 0.08 |
| Silver iodobromide emulsion l | 0.40 |
| SD-1 | $2.56 \times 10^{-4}$ |
| SD-2 | $3.50 \times 10^{-5}$ |
| SD-4 | $1.72 \times 10^{-4}$ |
| C-1 | 0.219 |
| CC-1 | 0.044 |
| D-1 | 0.024 |
| D-3 | 0.002 |
| AS-2 | 0.002 |
| OIL-4 | 0.001 |
| Gelatin | 0.84 |
| **5th Layer: High-speed Red-sensitive Layer** | |
| Silver iodobromide emulsion l | 0.10 |
| Silver iodobromide emulsion o | 0.38 |
| SD-1 | $7.11 \times 10^{-5}$ |
| SD-2 | $9.78 \times 10^{-6}$ |
| SD-3 | $4.72 \times 10^{-5}$ |
| C-1 | 0.046 |
| C-3 | 0.041 |
| CC-1 | 0.019 |
| D-3 | 0.003 |
| AS-2 | 0.001 |
| OIL-4 | 0.088 |
| Gelatin | 0.84 |
| **6th Layer: Interlayer** | |
| AS-1 | 0.20 |
| OIL-1 | 0.25 |
| Gelatin | 0.91 |
| **7th Layer: Low-speed Green-sensitive Layer** | |
| Silver iodobromide emulsion j | 0.23 |
| Silver iodobromide emulsion k | 0.10 |
| SD-4 | $1.17 \times 10^{-4}$ |
| SD-5 | $1.28 \times 10^{-5}$ |
| SD-6 | $1.61 \times 10^{-5}$ |
| M-1 | 0.275 |
| CM-1 | 0.085 |
| D-2 | 0.003 |
| D-3 | 0.001 |
| AS-2 | 0.001 |
| X-2 | 0.069 |
| AS-3 | 0.033 |
| OIL-1 | 0.410 |
| Gelatin | 1.14 |
| **8th Layer: Medium-speed Green-sensitive Layer** | |
| Silver iodobromide emulsion k | 0.09 |
| Silver iodobromide emulsion l | 0.33 |
| SD-4 | $3.83 \times 10^{-4}$ |
| SD-5 | $4.00 \times 10^{-5}$ |
| SD-6 | $5.00 \times 10^{-5}$ |
| M-1 | 0.101 |
| CM-1 | 0.039 |
| D-2 | 0.001 |
| D-3 | 0.012 |
| AS-2 | 0.001 |
| X-2 | 0.014 |
| AS-3 | 0.007 |
| OIL-1 | 0.280 |
| Gelatin | 1.06 |
| **9th Layer: High-speed Green-Sensitive Layer** | |
| Silver iodobromide emulsion j | 0.02 |
| Silver iodobromide emulsion n | 0.48 |
| SD-4 | $1.01 \times 10^{-4}$ |
| SD-5 | $3.78 \times 10^{-5}$ |
| SD-6 | $6.33 \times 10^{-6}$ |
| M-1 | 0.058 |
| CM-1 | 0.029 |

-continued

| | |
|---|---|
| AS-2 | 0.001 |
| X-2 | 0.015 |
| AS-3 | 0.007 |
| OIL-1 | 0.141 |
| Gelatin | 1.11 |
| 10th Layer: Yellow Filter Layer | |
| Yellow colloidal silver | 0.06 |
| AS-1 | 0.07 |
| OIL-1 | 0.09 |
| Gelatin | 0.90 |
| 11th Layer: Low-speed Blue-sensitive Layer | |
| Silver iodobromide emulsion j | 0.11 |
| Silver iodobromide emulsion l | 0.17 |
| Silver iodobromide emulsion m | 0.17 |
| SD-7 | $2.78 \times 10^{-4}$ |
| SD-8 | $7.17 \times 10^{-5}$ |
| Y-2 | 0.925 |
| AS-2 | 0.003 |
| OIL-1 | 0.371 |
| Gelatin | 1.91 |
| 12th Layer: High-sped Blue-sensitive Layer | |
| Silver iodobromide emulsion m | 0.03 |
| Silver iodobromide emulsion p | 0.25 |
| SD-7 | $2.78 \times 10^{-5}$ |
| SD-8 | $1.83 \times 10^{-5}$ |
| Y-2 | 0.078 |
| AS-2 | 0.001 |
| D-4 | 0.038 |
| OIL-1 | 0.047 |
| Gelatin | 0.61 |
| 13th Layer: First Protective Layer | |
| Silver iodobromide emulsion i | 0.22 |
| UV-1 | 0.10 |
| UV-2 | 0.06 |
| X-1 | 0.04 |
| AF-6 | 0.003 |
| Gelatin | 0.70 |
| 14th Layer: Second protective Layer | |
| PM-1 | 0.10 |
| PM-2 | 0.018 |
| WAX-1 | 0.02 |
| Gelatin | 0.55 |

In addition to the above composition were added coating aids SU-1, SU-2 and SU-3; a dispersing aid SU-4; viscosity-adjusting agent V-1; stabilizer ST-1; two kinds polyvinyl pyrrolidone of weight-averaged molecular weights of 10,000 and 1.100,000 (AF-1, AF-2); calcium chloride; inhibitors AF-3, AF-4, AF-5, Af-6 and AF-7; hardener H-1; and antiseptic Ase-1.

Characteristics of silver iodobromide emulsions used in sample 101, which were prepared in accordance with conventional method are below, in which the average grain size of silver iodobromide emulsions k, l, m, n, o, and p refers to an edge length of a cube having the same volume as that of the grain. Silver iodobromide emulsions were each in accordance with the method described in emulsion Em-2 in Examples of JP-A 2001-290232, provided that the pAg at the stage of ripening and growth, and flow rates of silver nitrate and halide solutions were respectively varied. Silver iodobromide emulsion i was comprised of octahedral grains having an average size of 0.043 $\mu$m and average iodide content of 1.9 mol %.

| Emul-sion | Av. Grain Size ($\mu$m) | Av. Iodide Content (mol %) | Av. Aspect Ratio |
|---|---|---|---|
| i | 0.28 | 2.0 | — |
| k | 0.61 | 3.1 | 5.43 |
| l | 0.89 | 3.7 | 6.10 |
| m | 0.95 | 8.0 | 3.07 |
| n | 1.43 | 3.9 | 6.76 |
| o | 1.50 | 3.1 | 6.60 |
| p | 1.23 | 7.9 | 2.85 |

With regard to the foregoing emulsions, except for emulsion i, after adding the foregoing sensitizing dyes to each of the emulsions and ripening the emulsions, triphenylphosphine selenide, sodium thiosulfate, chloroauric acid and potassium thiocyanate were added and chemical sensitization was conducted according to the commonly known method until relationship between sensitivity and fog reached an optimum point.

Chemical structures for each of the compounds used in the foregoing sample are shown below.

Y-2

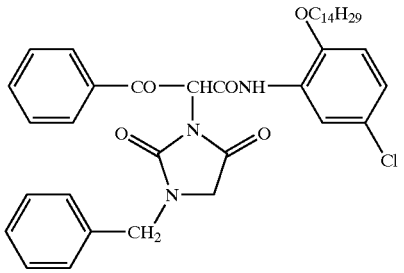

M-1

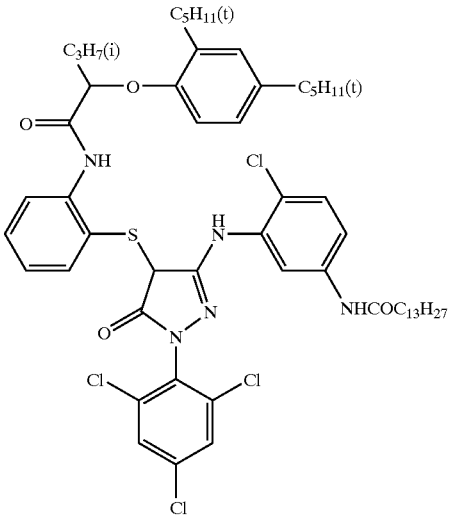

-continued
C-1
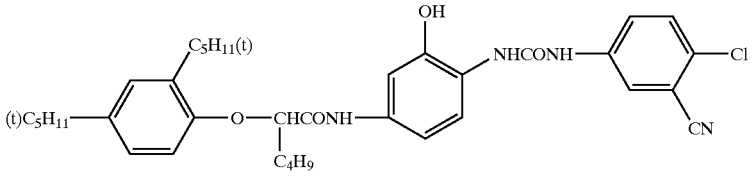
C-3
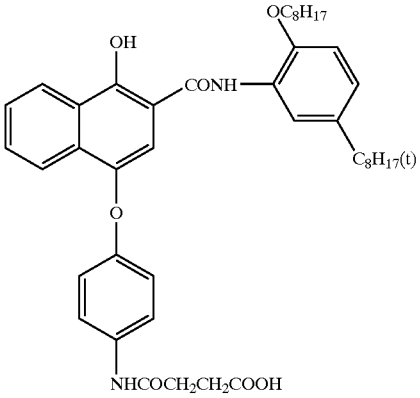
CC-1
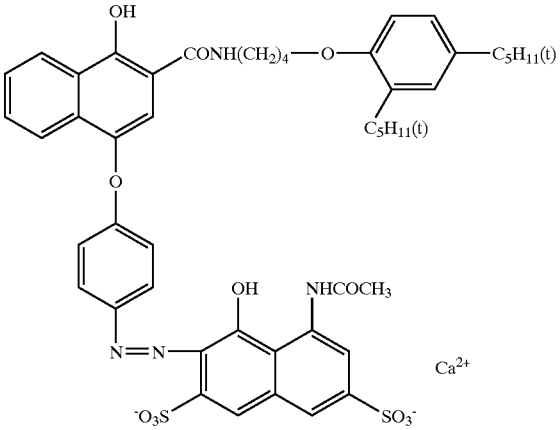
CM-1
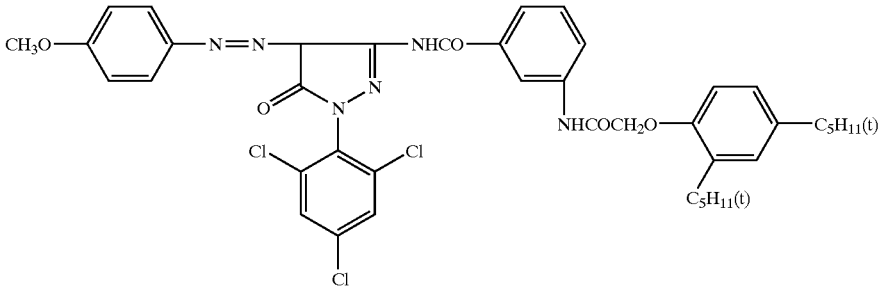
D-1
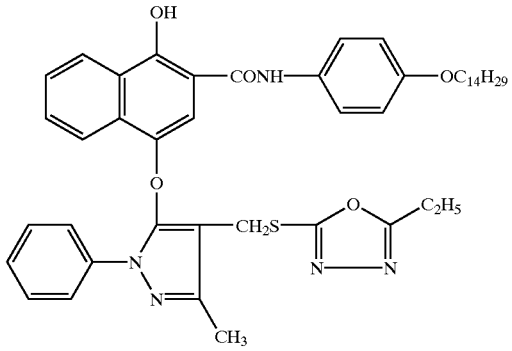
D-2
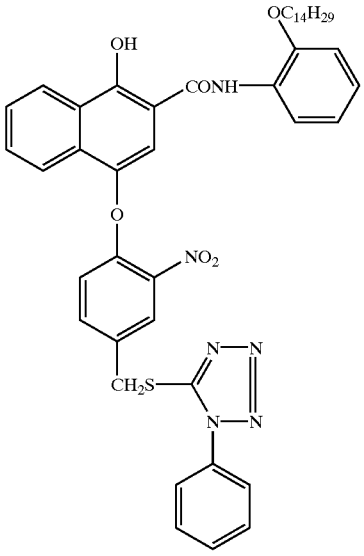

-continued
D-3
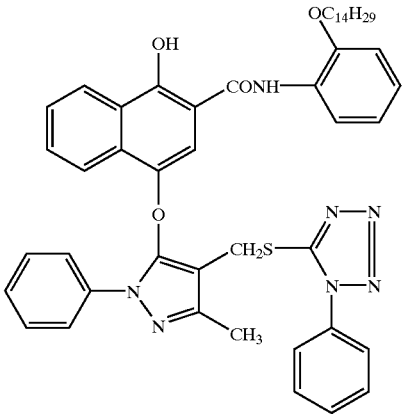
D-4
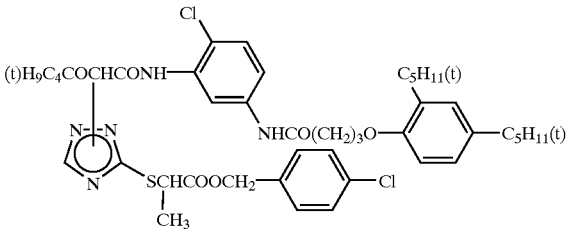
SD-1
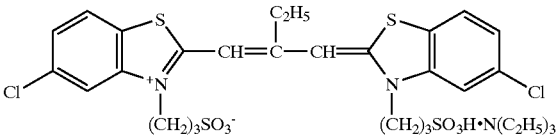
SD-2
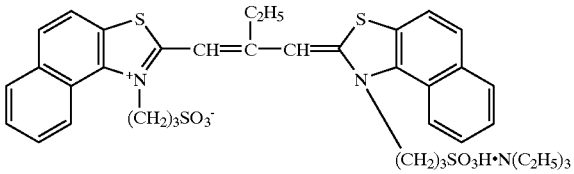
SD-3
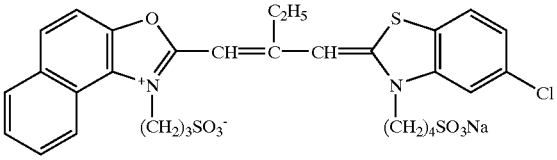
SD-4
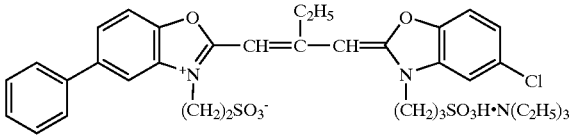
SD-5
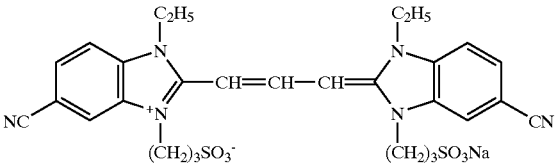
SD-6
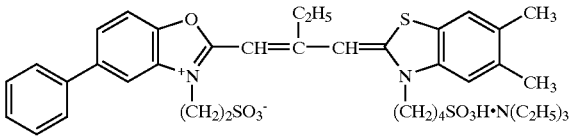
SD-7
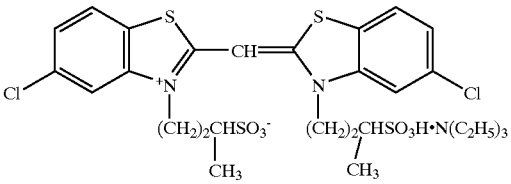
SD-8
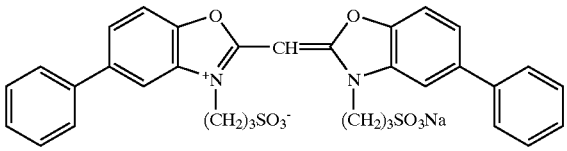
AS-1
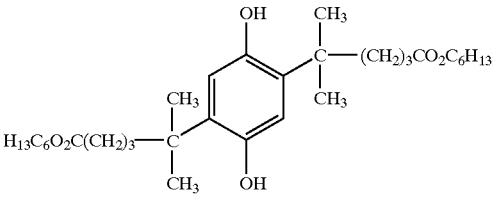
AS-2
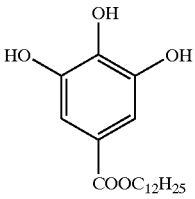

-continued
AS-3
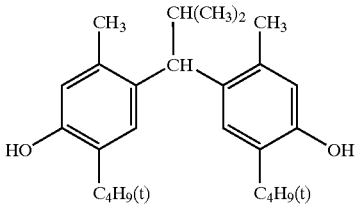
UV-1
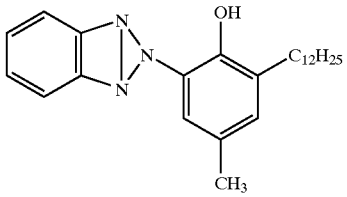
Liquid parafin
OIL-3
V-1
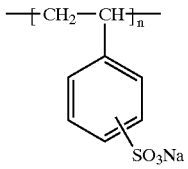
n: Degree of polymerization
H-1
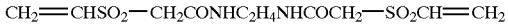
X-2
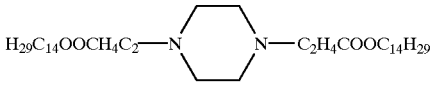
AF-1,2
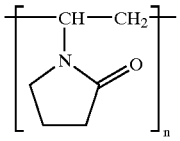
AF-1 Mw ≈ 10,000
AF-2 Mw ≈ 100,000
n: Degree of polymerization
AF-4
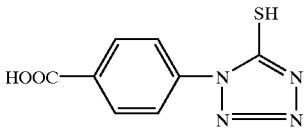
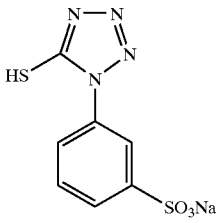
OIL-1
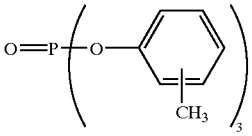
OIL-4
$H_9C_4OOC(CH_2)_8COOC_4H_9$
UV-2
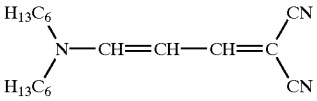
Ase-1 (mixture)
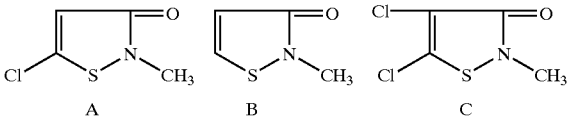
A B C
A:B:C = 50:46:4 (molar ratio)
H-2
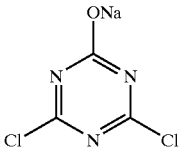
ST-1
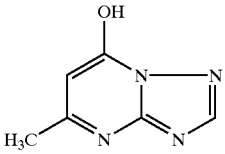
AF-3
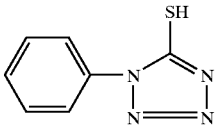
AF-5
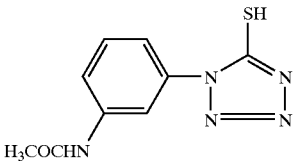
AF-6
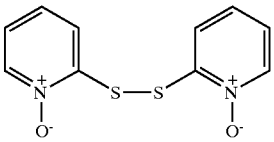
AF-7

-continued

X-1

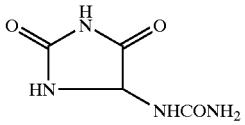

SU-1

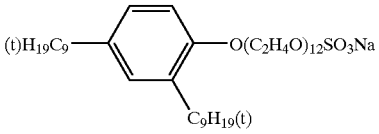

SU-2

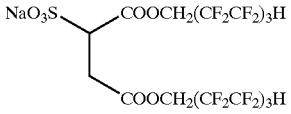

SU-3

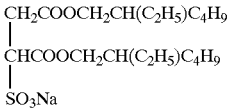

SU-4

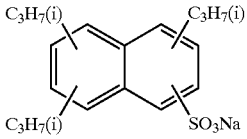

WAX-1

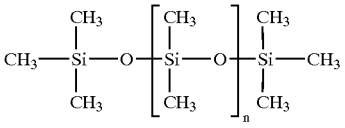

Mw = 3,000

PM-1

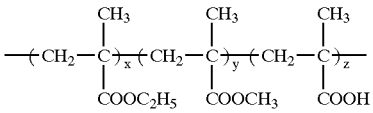

x:y:z = 3:3:4

PM-2

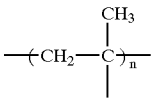

n: Degree of polymerization

Preparation of Samples 102 Through 125

Samples 102 through 125 were prepared similarly to Sample 101, provided that the average grain size, aspect ratio, chemical sensitization condition and amount of silver iodobromide emulsion and coupler amounts used in individual light-sensitive layer were adjusted so that the nominal speed, quality values QC and QT were those shown in Table 1.

Exposure

The thus prepared Samples 101 through 125 were each packed into a cartridge and loaded into a commercially available single-lens reflex camera. Using the camera, a Macbeth Color Checker Chart (comprised of 24 colored squares) was photographed under a light source having a color temperature of 4800° K with varying an exposure in which the aperture of the camera is reduced by 4 steps from the normal exposure (hereinafter, also referred to as −4 under-exposure) to an exposure in which the aperture was increased by 1 step from the normal exposure (hereinafter, also referred to as +1 over-exposure). Further, 100 shots for each of an outdoor scene against light and a stroboscopic (electronic-flashed) scene were photographed with varying an object distance by 4 steps and changing background colors of gray, white, black, green and yellow at varying exposure from =2 under-exposure to +1 over-exposure, while varying the number of objects from one person to five persons. Furthermore, scenes with a lighter background than the object, such as white wall or blue sky were photographed through center-weighted metering at an exposure ranging from −1 under-exposure to +1 over-exposure, including normal exposure. In addition to the foregoing, Samples 101 through 125 were each exposed through an optical wedge or a pattern wedge for MTF measurement for 1/200 sec. using a light source having a color temperature of 4800° K.

Processing

The thus exposed samples were subjected to color processing in accordance with processing steps described in JP-A No. 10-123652, col. [0220] through [0227], as shown below.

Process:

| Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 1 min. | 38 ± 5.0° C. | 830 ml |
| Drying | 1 min. | 55 ± 5.0° C. | — |

*:Amounts per $m^2$ of photographic material.

A color developer, bleach, fixer and stabilizer each were prepared according to the following formulas.

Color developer solution

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-(β-hydroxyethyl)-aniline sulfate | 4.5 g | 6.3 |
| Diethylenetriaminepentaacetic acid | 3.0 g | 3.0 g |
| Potassium hydroxide | 1.2 g | 2.0 g |

Water was added to make 1 liter in total, and the pH of the developer and replenisher were adjusted to 10.06 and 10.18, respectively, using potassium hydroxide and 20% sulfuric acid.

| Bleaching solution | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and replenisher was adjusted to 4.4 and 4.0, respectively, using ammoniacal water or glacial acetic acid.

| Fixer solution (worker and replenisher) | | |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Water was added to make 1 liter in total and the pH of fixer and replenisher was adjusted to 6.2 and 6.5, respectively, using ammoniacal water or glacial acetic acid.

| Stabilizer solution (worker and replenisher): | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Calculation of Quality Values QC, QG and QT

Using the thus processed samples, quality values, QC, QG and QT were each determined in the manner described earlier and obtained results are shown in Table 1. Thus, according to equation (1) described earlier, the quality value QC of the invention is 2.8 or more for photographic material of a nominal speed of 100, 2.2 or more for photographic material of nominal speed 200, 1.7 or more for photographic material of nominal speed 400, 1.3 or more for photographic material of nominal speed 800, and 1.0 or more for photographic material of nominal speed 1600. Further, as defined in the equation (5) described earlier, the preferred QT value is 3.3 or more for photographic material of the nominal speed of 100, 2.7 or more for photographic material of nominal speed 200, 2.2 or more for photographic material of nominal speed 400, 1.8 or more for photographic material of nominal speed 800, and 1.5 or more for photographic material of nominal speed 1600. Furthermore, as defined in the equation (14) described earlier, it is preferred that QTN be 4.2 or more for photographic material of the nominal speed of 100, 3.5 or more for photographic material of the nominal speed 200, 2.9 or more for photographic material of the nominal speed 400, 2.4 or more for photographic material of the nominal speed 800, and 2.0 or more for photographic material of the nominal speed 1600.

To calculate quality values of QC, QG and QT, preparation of characteristic curves and determination of granularity (RMS) and sharpness (MTF) were carried out in accordance with the following procedure.

Preparation of Characteristic Curve

Samples which were exposed through an optical wedge and processed in color processing were subjected to densitometry using a densitometer produced by X-rite Co. and characteristic curves comprised of an ordinate of density (D) and abscissa of exposure (logE) were prepared for each of yellow, magenta and cyan images.

Measurement of Granularity (RMS)

Scanning each of the processed samples with a microdensitometer was made at a scanning aperture area of 750 $\mu m^2$ (5 $\mu$m wide and 150 $\mu$m long slit) and the value of 1000 times a standard deviation of fluctuation in density for at least 1,000 density values was defined as RMS. In the measurement of RMS granularity of the green-sensitive layer (magenta image), Wratten filter W-99 (available from Eastman Kodak Co.) was used to separate green light. In the measurement of RMS granularity of the red-sensitive layer (cyan image), Wratten filter W-26 (available from Eastman Kodak Co.) was used to separate red light.

Measurement of MTF

Pattern wedge images for MTF measurement were subjected to densitometry using a microdensitometer and MTF values at 15 cycle/mm of magenta and cyan images were determined.

Variation of Color and Image Quality of Print

Evaluation (1-1): Analog Print of Under-Exposed Scene

Portrait scenes including outdoor scenes against light and stroboscopic scenes, which were photographed at an exposure varying from −2 under-exposure to +1 over-exposure of both sides of the normal exposure, based on center-weighted metering, while varying the object distance at 4 steps and background colors (gray, white, black, green and yellow), were printed on color print paper (Color Paper QA Type A7, produced by Konica Corp.) using an analog printer (Nice Print System NPS 858, one-channel type, produced by Konica Corp.) and processed (by Konica CPK-2-21) to output 100 prints per sample. The thus obtained prints were evaluated by 10 people having experience in using the printer with respect to color image quality of finished prints (print level), taking account of occurrence of variation of print level from the preferred neutral level, based on the following criteria:

A: excellently finished prints within less than 5% of color correction in printer;

B: occurrence of prints necessary to make 5 to 10% correction based on color buttons being less than 10%, leading to almost favorable finished prints;

C: occurrence of prints necessary to make 5 to 10% correction based on color buttons being 10 to 30%, falling within levels acceptable in practice;

D: occurrence of prints necessary to make 10 to 30% correction based on color buttons being within 30%, leading to unacceptable levels in practice.

Evaluation (1-2): Analog Print of Under-Exposed Scene

Portrait scenes with a lighter background than the object such as white wall or blue sky, which were photographed at varying exposure from −1 under-exposure to +1 over-exposure of both sides of the normal exposure, based on center-weighted average-metering, while varying the object distance in 4 steps and background colors (gray, white, black, green and yellow), were printed on color print paper (Color Paper QA Type A7, produced by Konica Corp.) using an analog printer (Nice Print System NPS 858, one-channel type, produced by Konica Corp.) and processed (by Konica CPK-2-21) to output 100 prints per sample. The thus obtained prints were visually evaluated by 10 amateur photographers with respect to color image quality of finished prints (print level), based on the following criteria:

A: excellent image quality including graininess and contrast over under-exposed scenes to normal exposure scenes;

B: slightly coarse graininess or slightly insufficient contrast being observed in under-exposed scenes but levels of almost favorable image quality;

C: slightly coarse graininess and slightly insufficient contrast being observed in under-exposed scenes but levels of almost favorable image quality and being acceptable in practice;

D: deteriorated graininess and lowered contrast being apparent and levels unacceptable in the market.

Total Evaluation of Image Quality of Analog Print

Combining the foregoing results of evaluations (1-1) and (1-2), total evaluation was made based on the following criteria:

5: A and B, or A and A in both evaluation results,

4: B and B in both evaluation results,

3: B and C in both evaluation results,

2: C and C in both evaluation results,

1: D in at least one evaluation result, wherein suitability for marketing is at a grade of 2 or more, and preferably 3 or more.

Results are shown in Table 1.

TABLE 1

| Sample No. | Nominal Speed | Quality Value QC | QG | QT | Analog Printer: Under-exposed Scene Evaluation (1–1) | Evaluation (1–2) | Total Evaluation | Remark |
|---|---|---|---|---|---|---|---|---|
| 101 | 100 | 2.8 | 3.7 | 3.3 | B | B | 4 | Inv. |
| 102 | 200 | 2.2 | 3.2 | 2.7 | B | B | 4 | Inv. |
| 103 | 400 | 1.7 | 2.8 | 2.2 | B | B | 4 | Inv. |
| 104 | 800 | 1.3 | 2.4 | 1.8 | B | B | 4 | Inv. |
| 105 | 1600 | 1.0 | 2.0 | 1.5 | B | B | 4 | Inv. |
| 106 | 100 | 3.1 | 4.0 | 3.6 | A | A | 5 | Inv. |
| 107 | 200 | 2.5 | 3.5 | 3.0 | A | A | 5 | Inv. |
| 108 | 400 | 2.0 | 3.1 | 2.5 | A | A | 5 | Inv. |
| 109 | 800 | 1.6 | 2.7 | 2.1 | A | A | 5 | Inv. |
| 110 | 1600 | 1.3 | 2.3 | 1.8 | A | A | 5 | Inv. |
| 111 | 100 | 2.8 | 3.1 | 3.0 | B | B | 4 | Inv. |
| 112 | 200 | 2.2 | 2.6 | 2.4 | B | B | 4 | Inv. |
| 113 | 400 | 1.7 | 2.2 | 1.9 | B | B | 4 | Inv. |
| 114 | 800 | 1.3 | 1.8 | 1.5 | B | C | 3 | Inv. |
| 115 | 1600 | 1.0 | 1.4 | 1.2 | B | C | 3 | Inv. |
| 121 | 100 | 2.5 | 3.4 | 3.0 | D | D | 1 | Comp. |
| 122 | 200 | 1.9 | 2.9 | 2.4 | D | D | 1 | Comp. |
| 123 | 400 | 1.4 | 2.5 | 1.9 | D | D | 1 | Comp. |
| 124 | 800 | 1.0 | 2.1 | 1.5 | D | D | 1 | Comp. |
| 125 | 1600 | 0.7 | 1.7 | 1.2 | D | D | 1 | Comp. |

As can be seen from Table 1, it was proved that samples meeting the quality value QC as defined in the invention resulted in superior finished print color quality and print image, specifically in the under-exposure region when printed using an analog printer.

Example 2

Preparation of Samples 201 Through 225

Samples 201 through 225 were prepared similarly to Sample 101 in Example 1, provided that the average grain size, aspect ratio, chemical sensitization condition and amount of silver iodobromide emulsion and amounts of coupler and colored coupler used in individual light-sensitive layer were varied so that the nominal speed, quality values QTN and minimum cyan density, as shown in Table 2, were achieved.

Exposure

The thus prepared samples 201 through 235 were each packed into a cartridge and loaded into a commercially available single-lens reflex camera. Using the camera, a Macbeth Color Checker chart (comprised of 24 colored squares) was photographed under a light source having a color temperature of 4800° K at varying exposure in which the aperture of the cameral is reduced in 4 steps from the normal exposure (hereinafter, also referred to as −4 under-exposure) to an exposure in which the aperture was increased by 1 step from the normal exposure (hereinafter, also referred to as +1 over-exposure). Further, scenes with a lighter background than the object, such as white wall or blue sky were photographed through center-weighted metering at an exposure ranging from −1 under-exposure to +1 over-exposure, including normal exposure. In addition to the foregoing, Samples 201 through 235 were each exposed through an optical wedge or a pattern wedge for MTF measurement for 1/200 sec. using a light source having a color temperature of 4800° K.

Processing

The thus exposed samples were processed similarly to Example 1.

Calculation of Quality Value QTN

Using the thus processed samples, quality values, QTM value was determined in accordance with the manner as described earlier and obtained results are shown in Table 2. To calculate quality value QTN, preparation of characteristic curves and determination of granularity (RMS) and sharpness (MTF) were carried out similarly to Example 1.

Variation of Color and Image Quality of Print Evaluation (2-1): Graininess of Digital Print Portrait scenes with a lighter background than the object, such as white wall or blue sky, which were photographed through center-weighted metering at a normal exposure, were printed on color print paper (Color Paper QA Type A7, produced by Konica Corp.) at a L print size (printing magnification: 4.5 times) or a panorama print size (printing magnification: 7.5 times) using a digital printer (KONICA QD21, produced by Konica Corp.) and processed (by Konica CPK-2-21) to obtain 100 prints of each size. The thus obtained prints were visually evaluated by 10 people (general users) with respect to color image quality of finished prints, compared to prints obtained by an analog printer in Example 1, and were graded based on the following criteria:

A: superior graininess in almost prints of L size and panorama size prints, compared to analog prints, B: superior graininess in at least 50% of each of L size and panorama size prints, compared to analog prints, C: superior graininess in 30 to 50% of each of L size and panorama size prints, compared to analog prints, D: equivalent graininess in L and panorama size prints to analog prints and no improvement was noted.

Evaluation (2-2): Contrast of Digital Print

L size prints used in the foregoing graininess evaluation were visually evaluated by 10 people (general users), comparing to analog prints, based on the following criteria:

A: superior contrast conversion having been achieved in at least 30% of scenes and no problem in other print qualities, compared to analog prints, B: superior contrast conversion having been achieved in 10 to 30% of scenes and no problem in other print qualities, compared to analog prints, C: equivalent contrast to analog prints and no problem in finishing, D: Comparing analog prints, contrast having been excessively enhanced, leading to unnatural prints and being unacceptable.

Total Evaluation of Image Quality of Digital Print

Combining the foregoing results of the evaluations (2-1) and (2-2), total evaluation was made based on the following criteria:

5: A and B, or A and A in both evaluation results,

4: B and B in both evaluation results,

3: B and C in both evaluation results,

2: C and C in both evaluation results,

1: D in at least one evaluation result, wherein no problem in suitability for marketing is at a grade of 2 or more, and preferably 3 or more.

Results thereof are shown in Table 2.

TABLE 2

| Sample No. | Nominal Speed | QC | QTN | Dmin (cyan) | Digital Print/ Correct-exposed Scene Graininess | Contrast | Total Image Quality | Remark |
|---|---|---|---|---|---|---|---|---|
| 201 | 100 | 2.8 | 4.2 | 0.19 | B | B | 4 | Inv. |
| 202 | 200 | 2.2 | 3.5 | 0.19 | B | B | 4 | Inv. |
| 203 | 400 | 1.7 | 2.9 | 0.19 | B | B | 4 | Inv. |
| 204 | 800 | 1.3 | 2.4 | 0.19 | B | C | 3 | Inv. |
| 205 | 1600 | 1.0 | 2.0 | 0.19 | C | C | 2 | Inv. |
| 206 | 100 | 3.1 | 4.5 | 0.19 | A | B | 5 | Inv. |
| 207 | 200 | 2.5 | 3.8 | 0.19 | A | B | 5 | Inv. |
| 208 | 400 | 2.0 | 3.2 | 0.19 | A | B | 5 | Inv. |
| 209 | 800 | 1.6 | 2.7 | 0.19 | B | B | 4 | Inv. |
| 210 | 1600 | 1.3 | 2.3 | 0.19 | B | B | 4 | Inv. |
| 211 | 100 | 2.8 | 4.2 | 0.16 | B | A | 5 | Inv. |
| 212 | 200 | 2.2 | 3.5 | 0.17 | B | A | 5 | Inv. |
| 213 | 400 | 1.7 | 2.9 | 0.17 | B | A | 5 | Inv. |
| 214 | 800 | 1.3 | 2.4 | 0.17 | B | A | 5 | Inv. |
| 215 | 1600 | 1.0 | 2.0 | 0.17 | B | B | 4 | Inv. |
| 221 | 100 | 2.5 | 3.9 | 0.19 | D | D | 1 | Comp. |
| 222 | 200 | 1.9 | 3.2 | 0.19 | D | D | 1 | Comp. |
| 223 | 400 | 1.4 | 2.6 | 0.19 | D | D | 1 | Comp. |
| 224 | 800 | 1.0 | 2.1 | 0.19 | D | D | 1 | Comp. |
| 225 | 1600 | 0.7 | 1.7 | 0.19 | D | D | 1 | Comp. |

As can be seen from Table 2, it was proved that samples meeting quality value QTV, as defined in equation (14) and having a minimum cyan density, Dmin (cyan) of less than 0.20 resulted in finished prints with superior graininess and contrast when printed using an analog printer.

Example 3

Using processed Samples 101, 102, 103, 106 through 110, 111 through 113, and 116 through 118 of Example 1, evaluation was made as follows.

Evaluation (3-1): Color Quality of Digital Print of Under-Exposed Scene

Portrait scenes used in Example 1, including outdoor scenes against light and stroboscopic scenes, which were photographed at varying exposure from −2 under-exposure to +1 over-exposure of both sides of the normal exposure, based on center-weighted metering, while varying the object distance at 4 steps and background colors (gray, white, black, green and yellow), were printed on color print paper using an analog printer (KONICA QD21, produced by Konica Corp.). The digital printer was run under the condition that correction for local printing was automatically made. The thus obtained prints were evaluated by 10 people having experience in using the printer with respect to color image quality of finished prints (print level), taking account of occurrence of variation of print level from the preferred neutral level, based on the following criteria:

A: excellently finished prints within less than 5% of color correction in the printer;

B: occurrence of prints necessary to make 5 to 10% correction based on color buttons being less than 10%, leading to almost favorably finished prints;

C: occurrence of prints necessary to make 5 to 10% correction based on color buttons being 10 to 30%, falling within acceptable levels in practice;

D: occurrence of prints necessary to make 10 to 30% correction based on color buttons being within 30%, leading to levels unacceptable in practice.

Evaluation (3-2): Image Quality of Digital Print of Under-Exposed Scene

Portrait scenes with a lighter background than the object such as white wall or blue sky, which were photographed at varying exposure from −1 under-exposure to +1 over-exposure of both sides of the normal exposure, based on center-weighted average-metering, while varying the object distance in 4 steps and background colors (gray, white, black, green and yellow), were printed on color print paper (Color Paper QA Type A7, produced by Konica Corp.) using an analog printer (Nice Print System NPS 858, one-channel type, produced by Konica Corp.) and a digital printer (KONICA QD21, produced by Konica Corp.) at a 2L print size (printing magnification: 5.6 times). The digital printer was run under the condition that correction for local printing was automatically made.

The thus obtained prints were visually evaluated by 10 people with respect to graininess and contrast of finished prints, based on the following criteria:

A: superior graininess and contrast having been achieved in at least 30% of the scenes and no problem in other print qualities, compared to analog prints, B: superior graininess and contrast having been achieved in 10 to 30% of scenes and no problem in other print qualities, compared to analog prints, C: equivalent graininess and contrast to analog prints and no problem in finishing, D: Comparing analog prints, contrast having been excessively enhanced and graininess having been roughened, falling outside acceptable levels.

Results are shown in Table 3.

TABLE 3

| Sample No. | Nominal Speed | Quality Value QC | Quality Value QT | Digital Print/ Under-exposed Scene Color Quality | Digital Print/ Under-exposed Scene Image Quality |
|---|---|---|---|---|---|
| 101 | 100 | 2.8 | 3.3 | B | B |
| 102 | 200 | 2.2 | 2.7 | B | B |
| 103 | 400 | 1.7 | 2.2 | B | B |
| 111 | 100 | 2.8 | 3.0 | B | C |
| 112 | 200 | 2.2 | 2.4 | B | C |
| 113 | 400 | 1.7 | 1.9 | B | C |
| 106 | 100 | 3.1 | 3.6 | A | A |
| 107 | 200 | 2.5 | 3.0 | A | A |
| 108 | 400 | 2.0 | 2.5 | B | A |
| 109 | 800 | 1.6 | 2.1 | C | B |
| 110 | 1600 | 1.3 | 1.8 | C | C |

As can be seen from Table 3, it was proved that prints printed by a digital printer from silver halide photographic material meeting the quality values QC and QT, as defined earlier exhibited little color variation and superior graininess and contrast, even in under-exposed scenes.

Example 4

Preparation Samples 501 through 509

Samples 501 through 509 were prepared similarly to Sample 101 in Example 1, provided that the average grain size, aspect ratio, chemical sensitization conditions, total silver coating amount and coupler amount used in individual light-sensitive layer were adjusted so that the nominal speed, quality values QC and QT, as shown in Table 1, were achieved, and infrared dyes were further added thereto.

Exposure and Processing of Samples

The thus prepared samples 501 through 509 were each packed into a cartridge and loaded into a commercially available single-lens reflex camera and a Macbeth Color Checker chart (comprised of 24 colored squares) was photographed under a light source having a color temperature of 4800° K at an under-exposure (under-exposed scenes) and at a normal exposure (normal scenes) and processed similarly to Example 1.

Evaluation of Noise Level in Digital Print

The thus processed samples were scanned by a digital printer (KONICA QP21, produced by Konica Corp.) to read image data for each of the colored squares. Image unevenness was calculated from bit values with respect to each of the 24 colored squares, the noise level of the under-exposed scene and that of the normal scene were each evaluated, based on the following criteria:

A: the noise level for under-exposed scenes or normal scenes being not more than 0.5% and being superior, B: the noise level for under-exposed scenes or normal scenes being within 0.5 to 1%, with an average of not more than 1% and being superior, C: the noise level for under-exposed scenes or normal scenes being within 1 to 2%, with an average of not more than 1.5% and superior, falling within acceptable levels in practice, D: the noise level for under-exposed scenes or normal scenes being more than 2%, with an average of more than 1.5%, leading to unacceptable levels in practice.

Tone Reproduction of Digital Print

The foregoing processed samples were printed on color paper using a digital printer (KONICA QD21, produced by Konica Corp.) and an analog printer (NPS858, produced by Konica Corp.) at an L size print (printing magnification: 4.7 times). The digital printer was run under the condition that correction for local printing was automatically made. Evaluation was made with respect to under-exposed and normal scenes.

The thus obtained digital prints were visually evaluated by 10 people with comparing analog prints, based on the following criteria:

A: at least 50% of the prints being superior in tone reproduction and the remainder being close to the analog prints and superior as finished prints, B: 20 to 50% of prints being superior in tone reproduction and the remainder being close to the analog prints and superior as finished prints, C: at least 80% of the prints being close in tone reproduction to analog prints, D: at least 50% of the prints being unpleasing in tone reproduction and no improved contrast being noted, leading to prints with unnatural image quality.

Results are shown in Tables 4 and 5.

TABLE 4

| Sample No. | Nominal Speed | Quality Value QC | Quality Value QT | Total Silver Coverage ($g/m^2$) | Total Infra-red Dye | Digital Print/ Under-exposed Scene Noise | Digital Print/ Under-exposed Scene Tone Reproduction |
|---|---|---|---|---|---|---|---|
| 501 | 100 | 2.8 | 3.3 | 3.4 | — | B | C |
| 502 | 200 | 2.2 | 2.7 | 3.8 | — | B | C |
| 503 | 400 | 1.7 | 2.2 | 4.6 | — | B | C |
| 504 | 100 | 2.8 | 3.3 | 4.2 | — | C | B |
| 505 | 200 | 2.2 | 2.7 | 4.6 | — | C | B |
| 506 | 400 | 1.7 | 2.2 | 5.4 | — | C | B |
| 507 | 100 | 2.8 | 3.3 | 3.4 | 3-26 | B | B |
| 508 | 200 | 2.2 | 2.7 | 3.8 | 3-26 | B | B |
| 509 | 400 | 1.7 | 2.2 | 4.6 | 3-26 | B | B |

TABLE 5

| Sample No. | Nominal Speed | QTN | Dmin (cyan) | Total Silver Coverage ($g/m^2$) | Total Infra-red Dye | Digital Printer: Normal scene Noise | Digital Printer: Normal scene Tone Reproduction |
|---|---|---|---|---|---|---|---|
| 501 | 100 | 4.2 | 0.19 | 3.4 | — | B | C |
| 502 | 200 | 3.5 | 0.19 | 3.8 | — | B | C |
| 503 | 400 | 2.9 | 0.19 | 4.6 | — | B | C |
| 504 | 100 | 4.2 | 0.19 | 4.2 | — | C | B |
| 505 | 200 | 3.5 | 0.19 | 4.6 | — | C | B |
| 506 | 400 | 2.9 | 0.19 | 5.4 | — | C | B |
| 507 | 100 | 4.2 | 0.19 | 3.4 | 3-26 | B | B |
| 508 | 200 | 3.5 | 0.19 | 3.8 | 3-26 | B | B |
| 509 | 400 | 2.9 | 0.19 | 4.6 | 3-26 | B | B |

As can be seen from Tables 4 and 5, it was proved that samples according to the invention produced prints exhibiting superior noise resistance and tone reproduction in both under-exposed and normal scenes, when printed using a digital printer, and the use of infrared dyes enhanced effects thereof.

What is claimed is:

1. A silver halide photographic material which is in the form of a roll film packaged in a cartridge, comprising on a support a red-sensitive layer, a green-sensitive layer and a blue-sensitive layer, wherein the photographic material satisfies the following equation (1):

$$QC \geqq 15.982 \times S^{-0.378} \quad (1)$$

wherein S represents a nominal speed of the photographic material, provided that $100 \leqq S \leqq 1600$; and QC represents a quality value which is determined by the process comprising:

(i) photographing a Macbeth color checker chart including 6 neutral gray areas and 18 color areas using the photographic material under a light source having a color temperature of 4800° K with a camera at an under-exposure of 3 stops-down from normal exposure in which the aperture of the camera is reduced by 3 steps from that of the normal exposure, (ii) processing the thus exposed photographic material, (iii) printing the processed photographic material on a color paper to produce a color print, under such an exposure condition that an area on the print, corresponding to a Neutral 5 gray area of the Macbeth color checker chart gives values of L*=50, a*=0 and b*=0, (iv) subjecting the print to chromaticity measurement to determine chroma values of areas on the print corresponding to the 18 color areas of the Macbeth color checker chart, and (v) calculating the QC value in accordance with the following equation (2):

$$QC=(Cr+Ch)/2 \quad (2)$$

wherein Cr and Ch are defined in the following equations (3) and (4):

$$Cr=20\times\log_{10}(Cr0) \quad (3)$$

$$Ch=7.0-3\times\log_{10}(Ch0) \quad (4)$$

wherein Cr0 is a ratio of a mean value of chroma values of 18 color areas of the Macbeth color checker chart to a mean value of chroma values of the areas on the print corresponding to the 18 color areas of the Macbeth color checker chart; and an absolute value of a difference in angle between a color vector of each of 18 colors of the Macbeth color checker chart and that of an area on the print corresponding to each of the 18 colors is determined and an average value of the thus determined absolute values of the 18 colors is defined as Ch0.

2. The photographic material of claim 1, wherein the photographic material satisfies the following equation (5):

$$QT \geqq 11.544 \times S^{-0.2752} \quad (5)$$

wherein S represents a nominal speed of the photographic material, provided that $100 \leqq S \leqq 1600$; and QT represents a quality value and is defined by the following equation (6):

$$QT=(QC+QG)/2 \quad (6)$$

wherein QC is the same as defined in claim 1; and QG is determined by the process comprising the steps of:

(i) photographing the Macbeth color checker chart using the photographic material under a light source having a color temperature of 4800° K with a camera at the under-exposure of 3 stops-down from normal exposure in which the aperture of the camera is reduced by 3 steps from that of the normal exposure, (ii) processing the thus exposed photographic material to determine magenta and cyan densities corresponding to the Neutral 5 gray area of the Macbeth color checker chart, which are designated as $Dg_1$ and $Dr_1$, (iii) exposing the photographic material to light through an optical wedge (iv) processing the exposed photographic material to prepare characteristic curves for magenta and cyan images, in which when exposures at densities $Dg_1$ and $Dr_1$ on the characteristic curves magenta and cyan images are designated as $\log Eg_1$ and $\log Er_1$, (v) calculating Rg and Rr in accordance with the following equations (7) and (8):

$$Rg=-7.0\times\log_{10}(3.4\times Rgav)+15.5 \quad (7)$$

$$Rr=-7.0\times\log_{10}(3.4\times Rrav)+15.5 \quad (8)$$

wherein Rgav is an average value of RMS granularity values of $RMSg_1$, $RMSg_2$ and $RMSg_3$ at densities of $Dg_1$, $Dg_2$ and $Dg_3$ on the characteristic curve of the magenta image and Rrav is an average value of RMS granularity values of $RMSr_1$, $RMSr_2$ and $RMSr_3$ at densities of $Dr_1$, $Dr_2$ and $Dr_3$ on the characteristic curve of the cyan image, in which $Dg_2$ and $Dr_2$ are respectively densities corresponding to exposures of $\log Eg_2=\log Eg_1-0.3$ and $\log Er_2=\log Er_1-0.3$ on the characteristic curves of the magenta and cyan images, and $Dg_3$ and $Dr_3$ are respectively densities corresponding to exposures of $\log Eg_3=\log gE_1+0.3$ and $\log Er_3=\log grE_1+0.3$ on the characteristic curves of the magenta and cyan images, (vi) calculating R in accordance with the following equation (9):

$$R=(7\times Rg+4\times Rr)/11 \quad (9)$$

(vii) calculating Mg and Mr in accordance with equations (10) and (11):

$$Mg=Mg0\times\gamma g\times 100 \quad (10)$$

Equation (11)

$$Mr=Mr0\times\gamma r\times 100 \quad (11)$$

wherein Mg0 and Mr0 are MTF values at a spatial frequency of 15 cycle/mm of magenta and cyan images obtained at the normal exposure, (viii) calculating M in accordance with the following equation (12):

$$M=7.0\times\log_{10}(Mg\times 0.7+Mr\times 0.3)-10 \quad (12)$$

and (ix) calculating QG using said M and R in accordance with the following equation (13):

$$QG=(0.413\times M^{-3.4}+0.422\times R^{-3.4})^{-1/3.4}-0.53 \quad (13).$$

3. The photographic material of claim 2, wherein the photographic material satisfies the following equation (14) and exhibits a cyan minimum density of less than 0.20 after having been processed:

$$QTN \geqq 14.838\times S^{-0.274} \quad (14)$$

wherein S represents a nominal speed of the photographic material, provided that $100 \leqq S \leqq 1600$; and QTN represents a quality value and is defined by the following equation (15):

$$QTN=(QCN+QGN)/2 \quad (15)$$

wherein QCN is a value which is determined similarly to the QC value as defined in claim 1, except that the Macbeth color checker chart (comprised of 24 colored squares) has been photographed with the photographic material using a light source having a color temperature of 4800° K at the normal exposure; and QGN is a value which is obtained similarly to the QG value as defined in claim 2, except that the Macbeth color checker chart (comprised of 24 colored squares) has been photographed with the photographic material using a light source having a color temperature of 4800° K at the normal exposure.

4. The silver halide photographic material of claim 2, wherein the photographic material exhibits a cyan minimum density of less than 0.20 after having been exposed and processed.

5. The photographic material of claim 1, wherein the photographic material satisfies the following equation (16):

$$B \leqq 10-10^{(-0.005 \times S+0.85)} \quad (16)$$

wherein B is a total silver coverage of the photographic material, expressed in $g/m^2$; S is a nominal speed of the photographic material, provided that $100 \leqq S \leqq 1600$.

6. The photographic material described of claim 1, wherein the photographic material contains an infrared dye having a main absorption within the wavelength region of 700 to 1100 nm.

7. The silver halide photographic material of claim 1, wherein the photographic material has a nominal speed of 100 to 400.

8. The silver halide photographic material of claim 1, wherein the nominal speed is an ISO speed.

* * * * *